US007937939B2

(12) United States Patent
Benson

(10) Patent No.: US 7,937,939 B2
(45) **Date of Patent: *May 10, 2011**

(54) BICYCLE THERMODYNAMIC ENGINE

(76) Inventor: Mark Christopher Benson, Milton, FL (US)

( * ) Notice: Subject to any disclaimer, the term of this patent is extended or adjusted under 35 U.S.C. 154(b) by 903 days.

This patent is subject to a terminal disclaimer.

(21) Appl. No.: 11/821,358

(22) Filed: Jun. 22, 2007

(65) Prior Publication Data

US 2007/0245727 A1 Oct. 25, 2007

Related U.S. Application Data

(63) Continuation-in-part of application No. 11/036,410, filed on Jan. 14, 2005, now Pat. No. 7,284,373.

(60) Provisional application No. 60/537,056, filed on Jan. 16, 2004.

(51) Int. Cl.
*F01B 29/10* (2006.01)

(52) U.S. Cl. ..... 60/519; 60/521; 60/524; 60/526

(58) Field of Classification Search ..... 60/517, 60/519, 524, 526, 521

See application file for complete search history.

(56) References Cited

U.S. PATENT DOCUMENTS

| | | | | |
|---|---|---|---|---|
| 3,460,344 | A * | 8/1969 | Johnson | 60/519 |
| 3,509,718 | A * | 5/1970 | Hohenhinnebusch et al. | 60/519 |
| 3,730,654 | A | 5/1973 | McMahon | |
| 3,909,162 | A | 9/1975 | Nutku | |
| 3,985,110 | A | 10/1976 | Doundoulakis | |
| 4,010,716 | A | 3/1977 | Minka | |
| 4,103,491 | A | 8/1978 | Ishizaki | |
| 4,183,214 | A | 1/1980 | Beale et al. | |
| 4,389,849 | A * | 6/1983 | Beggs et al. | 62/6 |
| 4,392,351 | A | 7/1983 | Doundoulakis | |
| 4,691,515 | A | 9/1987 | Ehrig et al. | |
| 4,753,073 | A | 6/1988 | Chandler | |
| 4,901,694 | A | 2/1990 | Sakita | |
| 4,926,639 | A | 5/1990 | Mitchell et al. | |
| 5,115,157 | A | 5/1992 | Blumenau | |
| 5,145,329 | A | 9/1992 | Zumbusch et al. | |
| 5,335,497 | A | 8/1994 | Macomber | |
| 5,622,149 | A | 4/1997 | Wittry | |
| 5,907,201 | A | 5/1999 | Hiterer et al. | |
| 6,195,992 | B1 | 3/2001 | Nommensen | |
| 6,513,326 | B1 | 2/2003 | Maceda et al. | |
| 6,701,708 | B2 | 3/2004 | Gross et al. | |
| 6,865,887 | B2 | 3/2005 | Yamamoto | |

(Continued)

FOREIGN PATENT DOCUMENTS

| | | |
|---|---|---|
| JP | 56-132441 | 10/1981 |

(Continued)

*Primary Examiner* — Hoang M Nguyen
(74) *Attorney, Agent, or Firm* — Simpson & Simpson, PLLC

(57) ABSTRACT

A thermodynamic cycle heat engine including a regenerator; a chamber in fluid communication with the regenerator; first and second rotors within the chamber, forming at least a pair of spaces within the chamber; and at least one actuator. The regenerator and the chamber form a portion of a closed space for a working fluid, the actuator is arranged to displace the rotors about an axis of rotation for the rotors, and at least a portion of the actuator is fixedly secured to the rotors. In some aspects, the actuator is arranged to receive energy from the rotors and operate as a generator, or a sensor is arranged to detect a condition associated with operation of the chamber and a controller is arranged to control the actuator responsive to the detected condition. In some aspects, the engine includes a heat exchanger in fluid communication between the regenerator and the chamber.

42 Claims, 24 Drawing Sheets

U.S. PATENT DOCUMENTS

| | | | | |
|---|---|---|---|---|
| 6,899,075 | B2 | 5/2005 | Saint-Hilaire et al. | |
| 6,996,983 | B2 | 2/2006 | Cameron | |
| 7,093,528 | B2 | 8/2006 | McFarland | |
| 7,284,373 | B1 * | 10/2007 | Benson | 60/524 |
| 2003/0000210 | A1 | 1/2003 | Gross et al. | |
| 2003/0215345 | A1 | 11/2003 | Holtzapple et al. | |
| 2004/0079321 | A1 | 4/2004 | Saint-Hilaire et al. | |

FOREIGN PATENT DOCUMENTS

| | | |
|---|---|---|
| JP | 2001-066005 | 3/2001 |
| JP | 2006-038251 | 2/2006 |
| JP | 2006-183649 | 7/2006 |
| WO | 98/09057 | 3/1998 |
| WO | 99/28685 | 6/1999 |

* cited by examiner

BICYCLE THERMODYNAMIC ENGINE

CROSS-REFERENCE TO RELATED APPLICATIONS

This application is a continuation-in-part of U.S. patent application Ser. No. 11/036,410, filed Jan. 14, 2005, now U.S. Pat. No. 7,284,373 entitled, "THERMODYNAMIC CYCLE ENGINE WITH BI-DIRECTIONAL REGENERATORS AND ELLIPTICAL GEAR TRAIN AND METHOD THEREOF", which claims the benefit under 35 U.S.C. §119 (e) of U.S. Provisional Application No. 60/537,056, filed Jan. 16, 2004.

FIELD OF THE INVENTION

The present invention relates generally to thermodynamic cycle heat engines. In particular, the present invention is an apparatus and method for a Stirling engine with bi-directional regenerators and directly driven rotors.

BACKGROUND OF THE INVENTION

Thermodynamic cycle heat engines (hereinafter referred to as engines or heat engines) apply the principles of heat regeneration and thermodynamic cycles to provide the power for the engine. These engines can be adapted to implement a number of thermodynamic cycles including the Stirling cycle. An engine employing the Stirling cycle (hereinafter referred to as a Stirling engine) includes a high temperature or expansion chamber and a low temperature or compression chamber. To increase efficiency, a regenerator also is added. Thermodynamic heat engines can typically work in a heater cycle or a cooler cycle. In a heater cycle, a working fluid expands in the hot chamber, due to heat applied to the chamber, and force is applied to a piston in the chamber by the expanding fluid. The heated fluid is forced from the high temperature chamber to the low temperature chamber through the regenerator, which absorbs portions of the heat contained in the working fluid. The cooled fluid, which can be further cooled in a heat exchanger, is returned to the high temperature chamber through the regenerator. The cooled fluid absorbs heat from the regenerator. The working fluid is then reheated to repeat the cycle.

A multi-cylinder Stirling engine (MSE) is described in U.S. Pat. No. 4,392,351. The MSE includes a bi-directional regenerator and a Stirling engine as described in U.S. Pat. No. 3,985,110. Unfortunately, the MSE uses a reciprocating movement of the rotors, which requires a complex mechanism and results in lower efficiency than a continuous movement. Also, the complex mechanical mechanisms require significant maintenance and sealing of the chambers is difficult due to the rotating plates used, which result in additional dynamic sealing surfaces. Further, the MSE uses a complex and torturous flow path for the fluid which decreases efficiency and increases compression of the fluid in the regenerator. Also, the regenerator for the MSE is external to the Stirling engine, requiring extra space, piping, and fittings.

The MSE also uses a pair of fixed and movable plates to control the phasing of the thermodynamic cycles. Unfortunately, these plates add to the size, weight, complexity, and cost of the engine. Further, the plates limit the surface area of the low and high temperature chambers that is in contact with the heat and cold sources necessary to motivate the Stirling cycle. For example, the ends of the chambers are essentially blocked by the respective plates. To make up for this loss of heat transfer capability, heat exchangers are used. Unfortunately, the exchangers decrease the efficiency and increase the size, complexity, and cost of the MSE.

The MSE attaches rotor lobes to exterior walls of chambers and rotates the chambers to affect movement of the attached rotors. Unfortunately, the rotation of the chambers further limits the direct exposure of the chambers to the cold and heat sources needed to power the Stirling cycle and can lead to seal problems.

A rotary Stirling engine (RSE) is described in U.S. Pat. No. 5,335,497. The efficiency of a heat engine is directly related to the change in pressure for the working fluid during the thermodynamic cycle. Unfortunately, the RSE does not isolate the hot and cold chambers. Thus, the compression of the working fluid occurs in the heat exchangers as well as the chambers, which decreases the efficiency of the engine. Also, the heat transfer between the working fluid and the heat exchangers is limited, since the working fluid is not allowed to remain at rest in the exchangers during the cycles. Further, the external heat exchangers and associated piping add to the size, complexity, and cost of the engine. Also, no more than two volumes can be created in each chamber, limiting the number of thermodynamic cycles that can be completed by one revolution of the rotors in the chambers. In addition, the RSE includes a complex flow path for the working fluid that results in reduced efficiency.

A rotary engine (RE) using separate compressor and combustion chambers is described in U.S. Pat. No. 4,901,694. Each chamber includes a single rotor with two lobes. Unfortunately, using only one rotor per chamber limits the number of cycles that can be completed per rotation of the rotors. Further, the RE uses valves incorporated in the rotors themselves, adding significantly to the complexity and cost of the RE. The gear train for the RE also is complex. For example, to move each rotor through one cycle per rotation, a sequence of four elliptical gears is used. Further, the gear train is one-sided, which results in vibration problems. The complex system of the RE requires extensive maintenance and is difficult to seal.

U.S. Pat. No. 6,996,983 (Cameron) teaches the general concept of a heat exchanger in use with a regenerator in a Stirling engine (heat sinks 126 and 130 and regenerator 130). Unfortunately, Cameron's teachings are limited to an engine with a linear motor and sliding displacer and are inapplicable to systems with rotary motors and rotating compression/expansion configurations.

U.S. Pat. No. 6,865,887 (Yamamoto) teaches the use of position sensing in a Sterling engine. Unfortunately, Yamamoto does not sense operational parameters such as temperature and pressure and therefore, is of no use in providing information about operating conditions in the engine. Further, Yamamoto's teachings are limited to an engine with a linear motor and sliding displacer and are inapplicable to systems with rotary motors and rotating compression/expansion configurations.

U.S. Pat. No. 6,701,708 (Gross et al.) teaches the use of an electric motor to rotate vanes in a Stirling engine. Further, Gross teaches an extremely unusual arrangement which is non-analogous to systems with rotary motors and rotating compression/expansion configurations.

U.S. Pat. No. 5,907,201 (Hiterer et al.) teaches a synchronous linear electric motor linked to drive a displacer in a displacer assembly for a Stirling cycle system. Cameron's teachings are inapplicable to systems with rotary motors and rotating compression/expansion configurations.

U.S. Pat. No. 4,389,849 (Gasser et al.) teaches the use of linear motors (48 and 52) to drive a piston and displacer. However, these teachings are inapplicable to systems with 30 rotary motors and rotating compression/expansion configurations. Gasser also teaches the use of position sensors and feedback for the control of a Sterling cycle cooler. Unfortunately, Gasser does not sense operational parameters such as temperature and pressure and therefore, is of no use in providing information about operating conditions in the engine.

U.S. Pat. No. 4,103,491 (Ishizaki) teaches heat exchanger (29) in-line between regenerator (23) and working chamber (6). However, Ishizaki teaches an unusual lobe configuration which is non-analogous to a system with rotors.

U.S. Published Application No. 2003/0215345 (Holtzapple et al.) teaches the use of proximity sensors and feedback for the control of oil temperature to regulate a gap in a gerotor apparatus for a Brayton cycle engine (see FIGS. 10-15 and page 5). Holtzapple also teaches the use of a flow measuring device to control air flow to a gap in the apparatus (see FIG. 7 and page 4). Unfortunately, Gasser does not sense operational parameters such as temperature and pressure associated with compression and expansion chambers and therefore, is of no use in providing information about operating conditions in the chambers.

What is needed is a thermodynamic cycle heat engine with isolated compression, transfer, and expansion cycles and optimized regeneration of the working fluid. Further, a means for increasing the number of thermodynamic cycles associated with each revolution of rotors in the chambers and an efficient gear train for controlling the rotors and cycles are needed. Also, it would be desirable to reduce the complexity of the engine and enable a greater exposure of the high temperature chamber and low temperature chambers to the respective thermal sources. What is further needed is improvement of the efficiency of the connection between motors and the rotors, sensing of parameters associated with operation of the chambers, additional heat exchange capability, and a simplified flow path and structure.

BRIEF SUMMARY OF THE INVENTION

The invention broadly comprises a thermodynamic cycle heat engine including: a regenerator; a chamber in fluid communication with the regenerator; first and second rotors disposed within the chamber, the first and second rotors forming at least a pair of spaces within the chamber; and at least one actuator. The regenerator and the chamber form at least a portion of a closed space for a working fluid, the at least one actuator is arranged to displace the first and second rotors about an axis of rotation for the first and second rotors, and at least a portion of the at least one actuator is fixedly secured to the first and second rotors.

In some aspects, the first and second rotors comprise first and second shafts, respectively, and the first and second shafts are fixedly secured to the at least one actuator. In some aspects, the first shaft is at least partially disposed within the second shaft. In some aspects, the engine includes a housing and at least a portion of the at least one actuator is disposed outside the housing. In some aspects, the engine includes a housing and the at least one actuator comprises first and second actuators and the first actuator is disposed outside the housing. In some aspects, the chamber is formed within a chamber structure and at least a portion of the at least one actuator is disposed within the chamber structure. In some aspects, the first and second rotors comprise first and second hubs, respectively, collinear with the axis of rotation and respective paddle sections radiating radially outward, with respect to the axis of rotation, from the first and second hubs, and at least a portion of the at least one actuator is at least partially disposed in the respective paddle sections.

In some aspects, the first and second rotors comprise first and second hubs, respectively, collinear with the axis of rotation, and at least a first portion of the at least one actuator forms the first and second hubs. In some aspects, the first and second hubs comprise all of the at least one actuator. In some aspects, the first and second rotors comprise first and second hubs, respectively, collinear with the axis of rotation, the at least one actuator comprises at least one first portion and at least one second portion, the at least one first portion forms the first and second hubs, and the at least one second portion is disposed outside the chamber.

In some aspects, the at least a portion of the at least one actuator includes at least one rotating component and the engine includes a torque path between the at least one rotating component and the first and second rotors, and the torque path is fixed with respect to the at least one rotating component and the first and second rotors. In some aspects, the at least one actuator further comprises at least one electric motor. In some aspects, the at least one actuator further comprises at least one hydraulic actuator. In some aspects, the at least one actuator is arranged to receive energy from the first and second rotors and to operate as a generator. In some aspects, the engine includes a sensor arranged to detect a condition associated with operation of the chamber and a controller arranged to receive a signal from the sensor regarding the condition and to control operation of the at least one actuator responsive to the signal. In some aspects, the engine includes a heat exchanger in fluid communication between the regenerator and the first chamber.

The invention also broadly comprises a thermodynamic cycle heat engine including: a regenerator; a first chamber in fluid communication with the regenerator; first and second rotors disposed within the first chamber, the first and second rotors forming at least a pair of first spaces within the first chamber; a first sensor arranged to detect a first condition associated with operation of the first chamber; and at least one first actuator arranged to displace the first and second rotors about an axis of rotation for the first and second rotors responsive to the detected first condition. The regenerator and the first chamber form a closed space for a working fluid. In some aspects, the engine includes a controller arranged to receive a signal from the first sensor regarding the first condition and to control operation of the at least one first actuator responsive to the signal.

In some aspects, the first and second rotors are independently displaceable about the axis of rotation and the controller is arranged to control relative rotation of the first and second rotors with respect to each other. In some aspects, the engine includes a second chamber in fluid communication with the regenerator and third and fourth rotors disposed within the second chamber. The controller is arranged to control phasing of the first and second rotors with respect to the third and fourth rotors and the regenerator and the first and second chambers form a closed space for a working fluid. In some aspects, the controller is arranged to: control a speed of the relative rotation between the first and second rotors or control circumferential spacing, with respect to the axis, between the first and second rotors. In some aspects, the at least one first rotary actuator is arranged to receive energy from the first and second rotors and to operate as a generator, the engine includes a heat exchanger in fluid communication with the regenerator and one of the first and second chambers, or at least a portion of the at least one first actuator is fixedly secured to the first and second rotors.

The invention further broadly comprises a thermodynamic cycle heat engine including: a regenerator; a chamber in fluid communication with the regenerator; and a heat exchanger in fluid communication between the regenerator and the chamber. The regenerator and the chamber form at least a portion of a closed space for a working fluid. In some aspects, the engine includes first and second rotors disposed within the chamber, the first and second rotors forming at least a pair of spaces within the chamber and at least one actuator. The at least one actuator is arranged to displace the first and second rotors about an axis of rotation for the first and second rotors and at least a portion of the at least one actuator is fixedly secured to the first and second rotors.

In some aspects, the engine includes a sensor arranged to detect a condition associated with operation of the chamber and a controller arranged to receive a signal from the sensor regarding the condition and to control operation of the at least one first actuator responsive to the signal. In some aspects, the engine includes first and second rotors disposed within the chamber, the first and second rotors forming at least a first pair of spaces within the chamber; and at least one actuator. The at least one actuator is arranged to receive energy from the first and second rotors and to operate as a generator.

The invention broadly comprises a thermodynamic cycle heat engine including: a regenerator; a compression chamber in fluid communication with the regenerator; first and second rotors disposed within the compression chamber, the first and second rotors forming at least a first pair of spaces within the compression chamber; an expansion chamber in fluid communication with the regenerator; third and fourth rotors disposed within the expansion chamber, the third and fourth rotors forming at least a second pair of spaces within the expansion chamber; at least one first and second rotary actuators; a sensor arranged to detect a condition associated with one of the first and second chambers; and a controller arranged to receive a signal from the sensor regarding the condition and to control operation of one of the at least one first and second actuators responsive to the signal. The regenerator and the compression and expansion chambers form a closed space for a working fluid, the at least one first rotary actuator is arranged to displace the first and second rotors about an axis of rotation for the first and second rotors and the at least one second rotary actuator is arranged to displace the third and fourth rotors about an axis of rotation for the third and fourth rotors, and at least a portion of the at least one first actuator is fixedly secured to the first and second rotors and at least a portion of the at least one second actuator is fixedly secured to the third and fourth rotors.

The present invention also includes methods for operating a thermodynamic cycle heat engine.

It is a general object of the present invention to provide an apparatus and method for directly driving rotors in a heat engine.

It is another object of the present invention to provide an apparatus and method for detecting conditions associated with operation of a chamber in a heat engine and controlling actuating devices accordingly.

It is still another object of the present invention to provide an apparatus and method for providing additional heat exchange capacity between chambers in a heat engine and heat sources and sinks for the engine.

It is a further object of the present invention to provide an apparatus and method for using a heat engine as a generator.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify substantially identical structural elements of the invention. While the present invention is described with respect to what is presently considered to be the preferred embodiments, it is understood that the invention is not limited to the disclosed embodiments.

Furthermore, it is understood that this invention is not limited to the particular methodology, materials and modifications described and as such may, of course, vary. It is also understood that the terminology used herein is for the purpose of describing particular embodiments only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
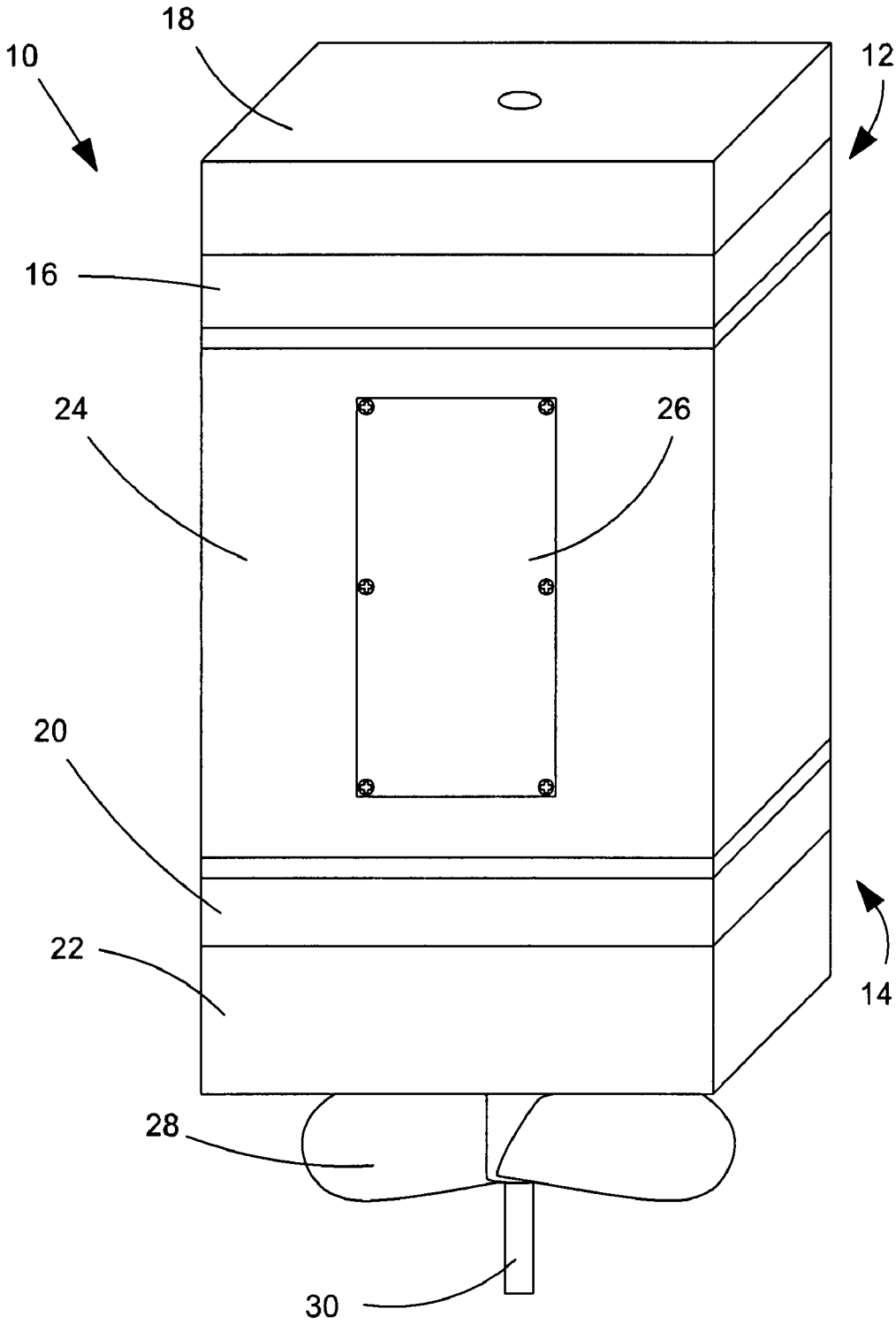
FIG. 1 is a perspective view of a present invention engine.

FIG. 1 is a perspective view of a present invention engine 10. It should be understood that engine 10 can function as an engine (provide output power) or can be used as a heat pump or cooler. Engine 10 includes expansion chamber 12 and compression chamber 14. Note that expansion chamber 12 and compression chamber 14 also can be referred to as a high temperature chamber or a low temperature chamber, respectively. Chamber 12 includes expansion plate 16 and expansion cap 18. Chamber 14 includes expansion plate 20 and expansion cap 22. As further described below, plates 16 and 20 and caps 18 and 22 form a respective volume within chambers 12 and 14. Insulator 24 covers the portion of engine 10 between the chambers. Insulator 24 can be made of any insulating material known in the art. The thickness and structural characteristics of insulator 24 can be selected as needed for any particular application. For example, if engine 10 is installed in an accessible area in which the engine could be damaged, insulator 24 can be made of a sturdy material that would resist blows or other physical intrusions. Access panel 26 covers an opening (not shown) enabling access to the portion of engine 10 between the chambers. The size and position of panel 26 can be determined according to the requirements of any particular application. Engine 10 is shown in the shape of a rectangular block. However, it should be understood that engine 10 is not restricted to any particular shape and can be configured in any geometry necessary for a particular application. For example, engine 10 can be cylindrical in shape. In some aspects, engine 10 includes fan 28 connected to shaft 30. In the embodiment shown, chamber 14 is the compression chamber, therefore, fan 28 provides useful cooling for chamber 14.

Engine 10 can approximate thermodynamic cycles including the Stirling and Ericsson cycles by adjusting the phasing and shaping gears and drive systems. Engine 10 can provide output power at a drive shaft (for example, shaft 30) or can receive power via a drive shaft to operate as a heat pump or cooler. Chambers 12 and 14 and the bi-directional regenerators described below form a closed space containing a working fluid. The working fluid may be hydrogen, helium, or any other gas or liquid known in the art. Thermodynamic cycles are performed on the working fluid as further described below.

Figure 2:
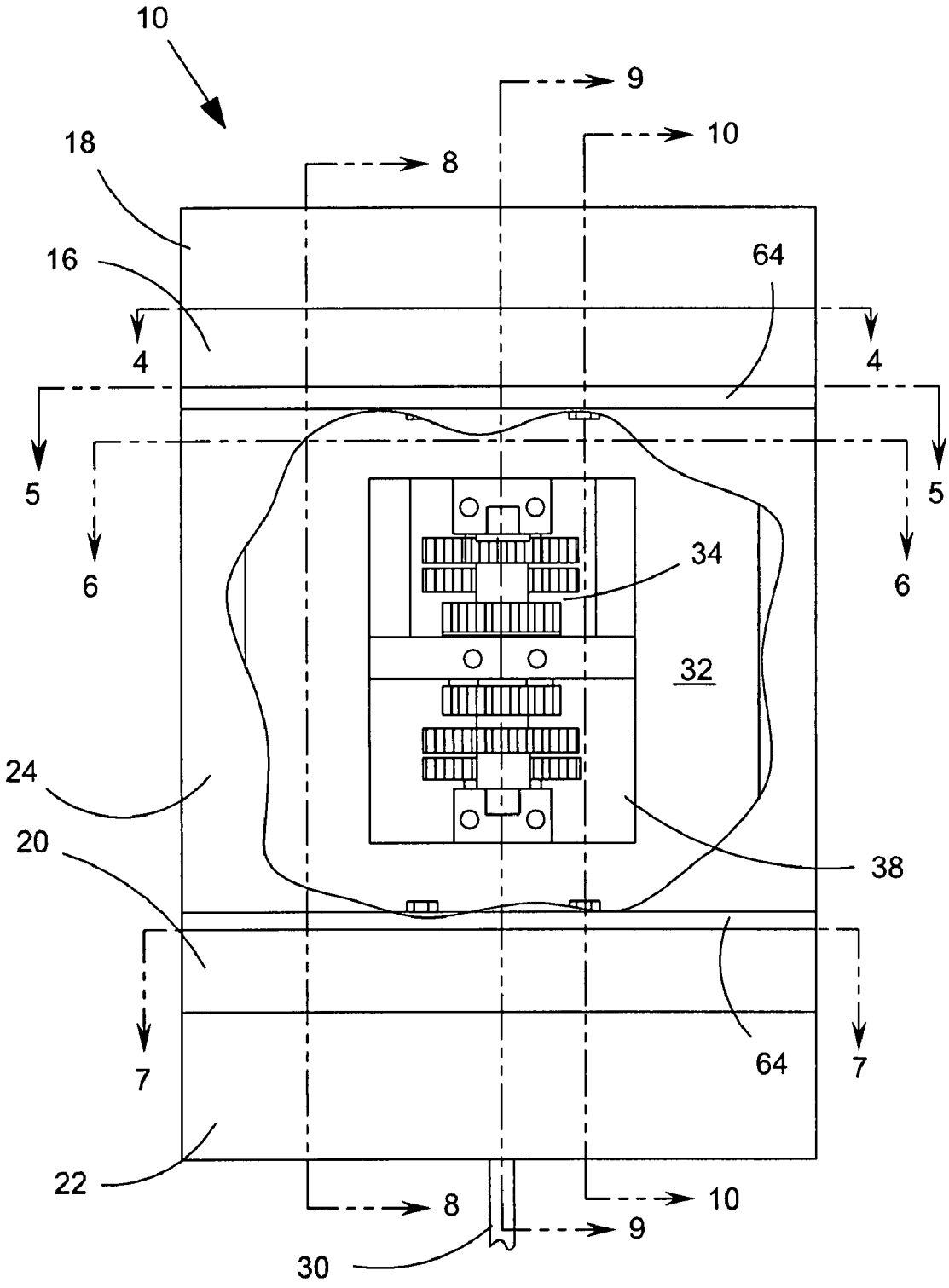
FIG. 2 is a side view of the engine of FIG. 1 with the access panel removed and the insulator partially removed.

FIG. 2 is a side view of the engine of FIG. 1 with access panel 26 removed and insulator 24 partially removed. In some aspects, housing 32 forms a compact structural foundation for engine 10, reducing the size, complexity, and cost of manufacturing engine 10. Chambers 12 and 14 are mounted on opposing sides of housing 32. Bi-directional regenerators (not shown) and gear train 34 (portions are shown) also are mounted in housing 32. This arrangement has a myriad of advantages. The drive mechanism interfaces with the chambers through the respective plates, leaving the large surface area of the caps and portions of the plate surface to contact the hot and cold reservoirs. Increasing the contact area optimizes heat exchange between the chambers and the reservoirs. Thus, extensive thermal transfer is possible without the use of heat exchangers or other ancillary equipment. The cap may be a single layer or have one layer tailored for the inside of the chamber and an outer layer to provide strength and shaped to provide the best heat exchange for the application. Chambers 12 and 14 are separated by housing 32, increasing the efficiency of the respective thermodynamic processes occurring in the chambers. Chambers 12 and 14 can be triode, 'D', or any other shape known in the art to optimize heat transfer.

Figure 3:
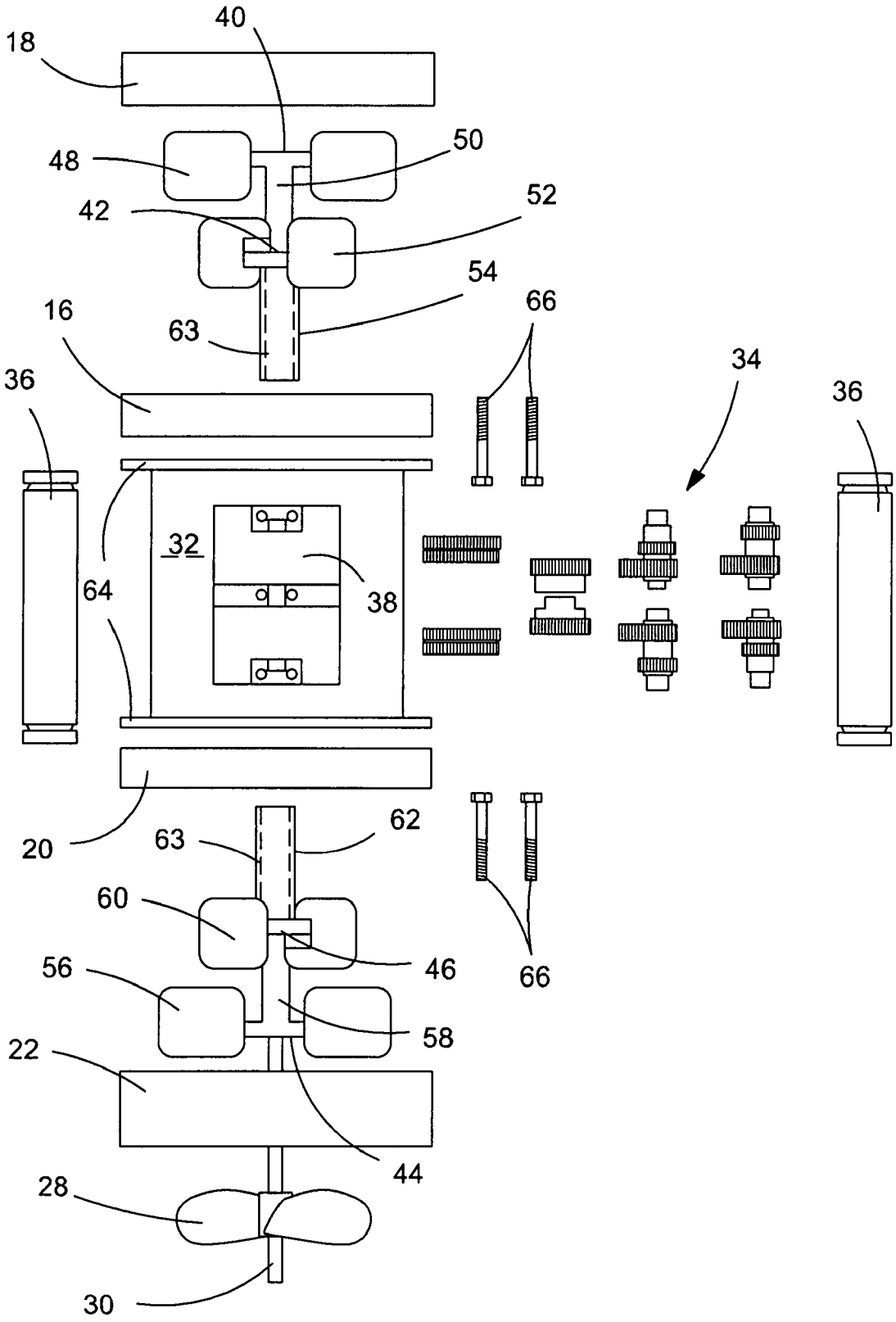
FIG. 3 is an exploded view of the engine shown in FIG. 1.

FIG. 3 is an exploded view of the engine shown in FIG. 2. To simplify the presentation, insulator 24 is not shown. Gear train 34 and bi-directional regenerators 36 are positioned in space 38 within housing 32. In FIG. 3, regenerators 36 are shown as modular units. However, it should be understood that the regenerators can be made integral to housing 32 (not shown). Plate 16 and cap 18 form a space or cavity (not shown) in which rotors 40 and 42, also referred to as expansion rotors, are located. Plate 20 and cap 22 form a space or cavity (not shown) in which rotors 44 and 46, also referred to as compression rotors, are located. The cavities are further described below. Rotor 40 includes lobes 48 and shaft 50. Rotor 42 includes lobes 52 and shaft 54. Rotor 44 includes lobes 56 and shaft 58. Rotor 46 includes lobes 60 and shaft 62. In general, each chamber includes at least two rotors and each rotor includes at least one lobe. However, engine 10 is not limited to any particular number of rotors per chamber or lobes per rotor. In general, for the rotors in a particular chamber, the number of lobes and the shape of the lobes match. In some aspects, rotors 40 and 42 and 44 and 46 are interlaced. Shafts 54 and 62 include openings 63 parallel to a longitudinal axis (not shown) for each shaft and shafts 50 and 58, respectively, pass through openings 63 and rotate within openings 63. In general, a fluid-tight seal is maintained between the interlaced portions of rotors 40 and 42 and 44 and 46 using any means known in the art.

Plates 16 and 20 can be mounted to housing 32 using any means known in the art. In some aspects, housing 32 includes flanges 64, used for mounting plates 16 and 20. Any means known in the art can be used to mount the plates to the flanges. For example, holes (not shown) can be formed in the flanges to pass bolts 66 that thread into the respective plate. In general, the seal between the flanges and plates should be substantially fluid-tight. Thus, it should be understood that any additional means known in the art for ensuring a fluid-tight seal (not shown) can be used. These sealing means could include rings, gaskets, or sealing compounds.

Figure 4:
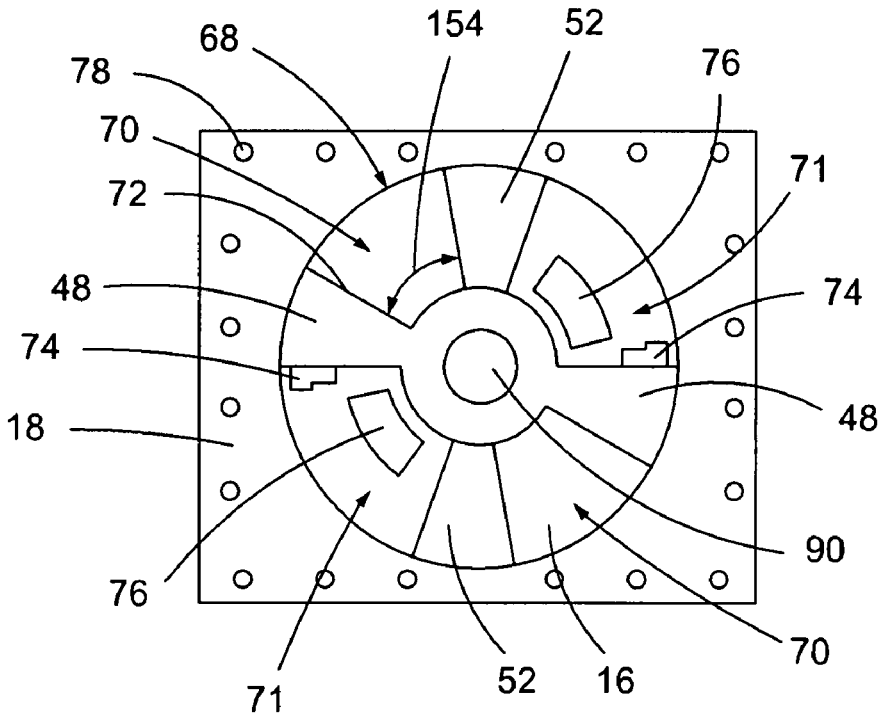
FIG. 4 is a cross-sectional view of the engine shown in FIG. 2 along lines 4-4.

FIG. 4 is a cross-sectional view of the engine shown in FIG. 2 along lines 4-4. The following should be viewed in light of FIGS. 3 and 4. As noted above, cap 18 is configured to form, with plate 16, a volume within chamber 12. In FIG. 4, this volume is shown as a radial cross-section of cavity 68. In general, the radial cross-sections of the chambers (as shown in FIG. 4) for engine 10 are circular to accommodate the rotation of the respective rotors within the chambers. Rotors 40 and 42 are positioned within cavity 68. In general, a pair of volumes or spaces is formed by each pair of lobes in a chamber. Therefore, at least one pair of spaces is formed in each chamber by the respective lobes in the chamber. Lobes 48 and 52 are interleaved to form two pairs of volumes or spaces 70 and 71, also called expansion spaces, within cavity 68. In general, respective rotors and chamber cavities are closely matched in shape. For example, the rotor shafts 50 and 54 fill a central portion of cavity 68, leaving a toroidal space through which lobes 48 and 52 rotate. Spaces 70 and 71 are formed within the toroidal space. Seals (not shown) are provided at the edges of the lobes, for example edge 72 of lobe 48 such that the spaces 70 and 71 are substantially fluidly isolated from each other. Any means known in the art can be used to seal the lobe edges. As further described below, rotors 40 and 42 rotate in the same direction around shafts 50 and 54, respectively, in cavity 68. Engine 10 can be configured so that rotors 40 and 42 rotate either clockwise or counterclockwise.

High pressure ports 74 in plate 16 are in fluid communication with the high pressure connections (not shown) for regenerators 36. Low pressure ports 76 in plate 16 are in fluid communication with the low pressure connections (not shown) for regenerators 36. The low pressure and high pressure connections are further described below. As rotors 40 and 42 rotate, ports 74 and 76 are cyclically covered and uncovered by lobes 48 and 52, as further described below. Cap 18 can be connected to plate 16 by any means known in the art. For example, holes 78 can be used to accommodate fasteners (not shown). It should be understood that the above description is applicable to plate 20, cap 22, and rotors 44 and 46.

Figure 5:
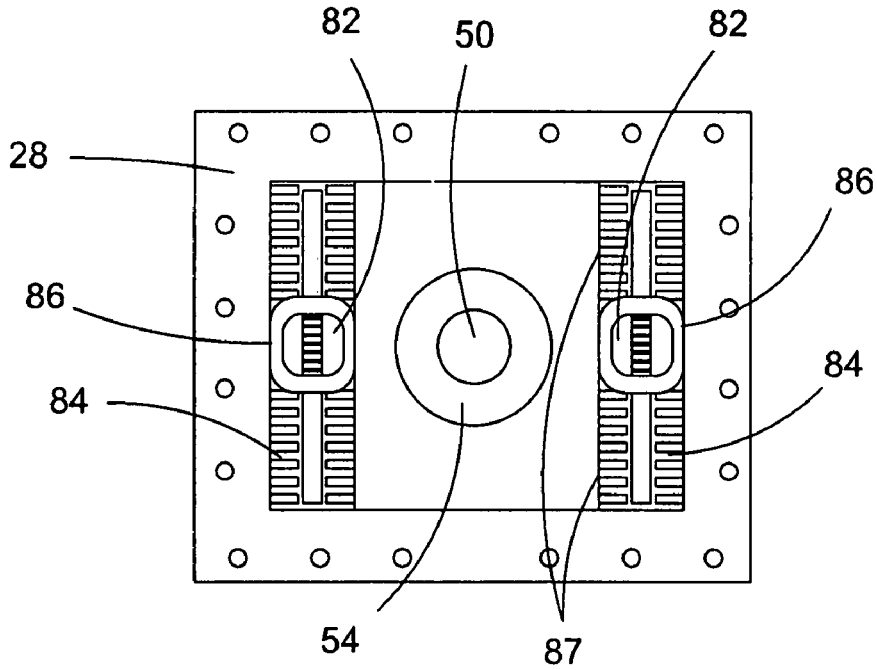
FIG. 5 is a cross-sectional view of the engine shown in FIG. 2 along lines 5-5.

FIG. 5 is a cross-sectional view of the engine shown in FIG. 2 along lines 5-5. The following should be viewed in light of FIGS. 3 through 5. Engine 10 advantageously separates the compression and expansion cycles occurring within the engine. This is partially accomplished by using separate chambers 12 and 14 and by isolating the low pressure and high pressure paths in regenerators 36. Thus, each regenerator 36 includes a high pressure passage or connection 82 and a low pressure passage or connection 84. These connections are separate from each other and are used during different parts of the thermodynamic cycle, as described below. In some aspects, connections 82 and 84 share at least one common wall. In FIG. 5, connection 82 shares two sidewalls with connection 84. It should be understood that connections 82 and 84 are not restricted to any particular shape or configuration. For example, fins or other protrusions can be used to increase the surface area of the connections or to control the direction or speed of the working fluid through the connection.

In some aspects, connection 82 includes a port 86, which is in fluid communication with chambers 12 and 14 as described below. Connection 84 typically has a larger input/output area. For example, in some aspects, the entire top cross-section 87 of connection 84, with the exception of the area occupied by port 86 is open for fluid communication. In some aspects, each port 74 is directly connected to a separate port 86 in a respective regenerator 36 and each port 86 in engine 10 is separate from the remaining ports 86. In some aspects, each port 76 is in fluid communication with a connection 84 for a respective regenerator 36. That is, there is a one-to-one correspondence between the ports in chamber 12 and 14 and connections 82 and 84. In some aspects, for example, as shown in FIG. 5, both ports 76 for chamber 12 or 14 are in fluid communication with both regenerators 36. That is, both connections 84 in FIG. 5 are in fluid communication.

The volumes of connections 82 and 84 are selected to increase the efficiency of engine 10. In general, the efficiency of engine 10 is directly related to the changes in the volumes of the working fluid taking place within the compression and expansion spaces. Alternately stated, minimizing the energy needed to complete the compression and expansion phases increases the amount of useful work the engine can output or perform. Thus, as the working fluid moves from chamber 14 to chamber 12 through connection 82, it is desirable to compress the fluid. Therefore, the volume of connection 82 is minimized. As the working fluid moves from chamber 12 to chamber 14, it is desirable to avoid compressing the fluid. Therefore, the volume of connection 84 is maximized. The volume of connection 84 is relatively large for at least two other reasons. First, the present invention optimizes the expansion phase by overlapping the discharge from the pairs of expansion spaces in chamber 12 to connection 84. For example, in engine 10, both pairs of expansion spaces in chamber 14 discharge fluid into connections 84 at the same time. Thus, the volume of connections 84 must be large enough to accommodate the combined volume of the expansion spaces. In those aspects in which each port 76 is connected to a separate connection 84, each connection 84 has a volume greater than the volume of the respective expansion space. Second, it is desirable to optimize heat transfer for the working fluid as it passes through connection 84. Thus, a larger volume for connection 84 results in a longer transit time for the working fluid in connections 84 as well as greater surface areas in connections 84 to which to transfer thermal energy. The cross-sectional areas of connections 82 and 84 also can be selected to optimize the performance of the connections. For example, the cross-sectional area of connections 82 is generally less than the cross-sectional area of connections 84 for the reasons noted above.

Figure 6:
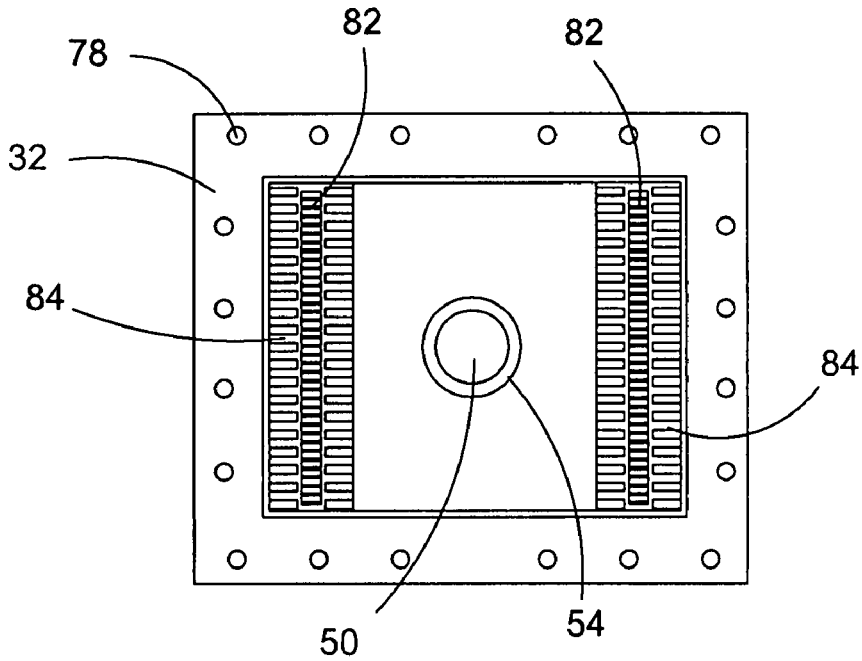
FIG. 6 is a cross-sectional view of the engine shown in FIG. 2 along lines 6-6.

FIG. 6 is a cross-sectional view of the engine shown in FIG. 2 along lines 6-6. FIG. 6 further illustrates the nesting of connection 82 within connection 84.

Figure 7:
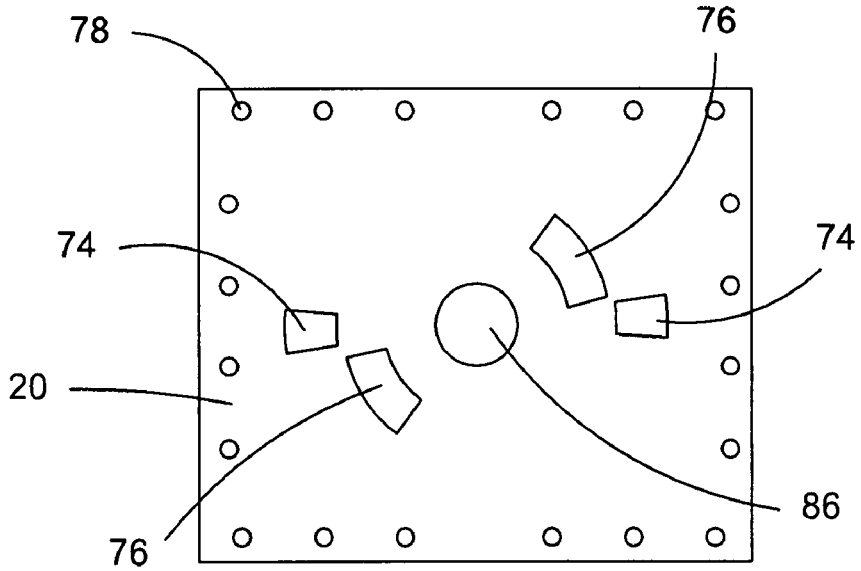
FIG. 7 is a cross-sectional view of the engine shown in FIG. 2 along lines 7-7.

FIG. 7 is a cross-sectional view of the engine shown in FIG. 2 along lines 7-7. The following should be viewed in light of FIGS. 3, 4, and 7. Plate 20 includes ports 74 and 76. Shafts 58 and 62 pass through opening 86 in plate 14 for connection to gear train 34. Note that plate 12 includes a similar opening for shafts 50 and 54.

Figure 8:
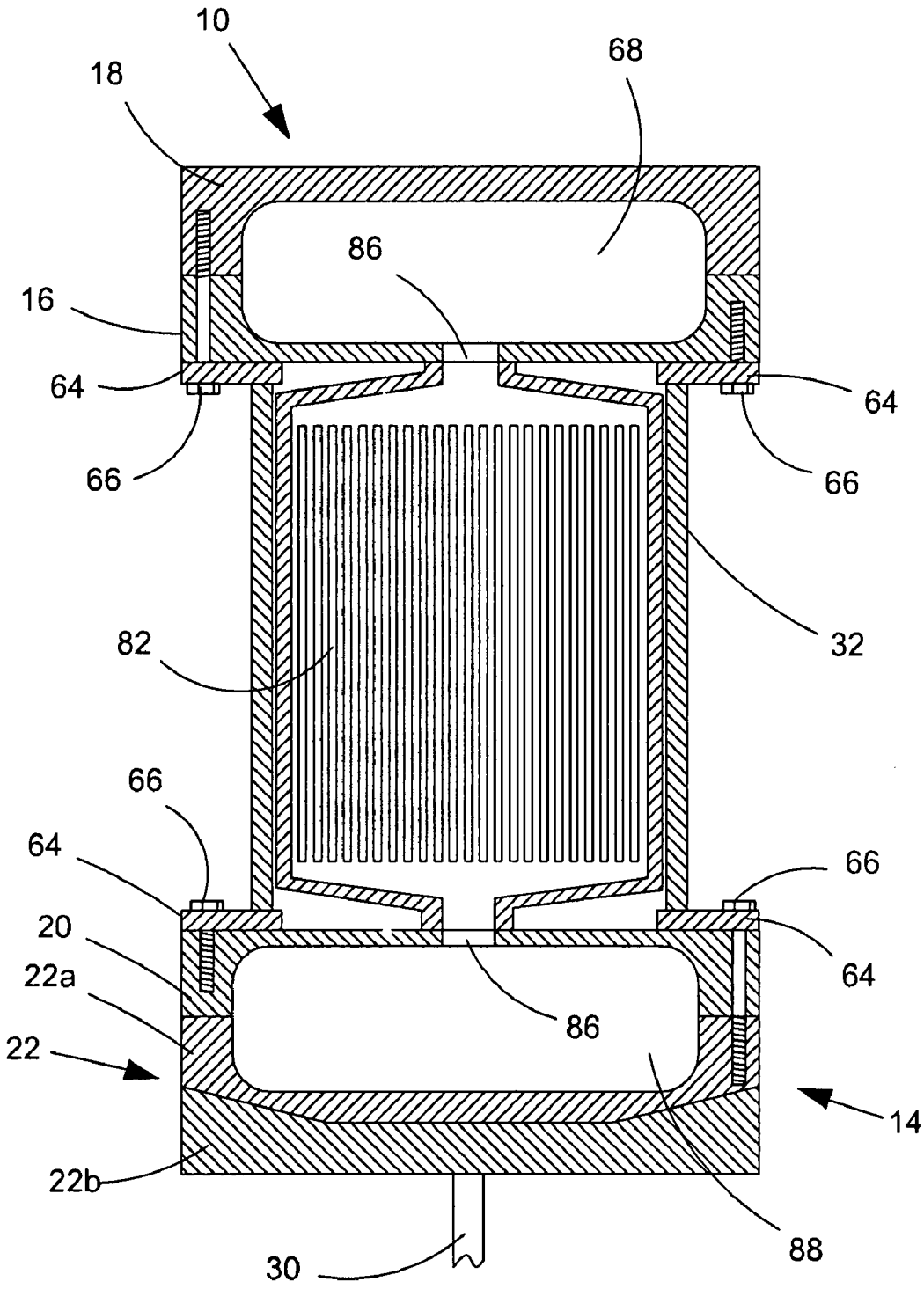
FIG. 8 is a cross-sectional view of the engine shown in FIG. 2 along lines 8-8.

FIG. 8 is a cross-sectional view of the engine shown in FIG. 2 along lines 8-8. The following should be viewed in light of FIGS. 5, 6, and 8. In FIG. 8, the rotors are not shown, to more clearly illustrate cavities 68 and 88 in chambers 12 and 14, respectively. FIG. 8 also shows further detail of connection 82. In some aspects caps 18 or 22 can be made of multiple layers or components to optimize a desired characteristic, for example, the portion in contact with the rotors can be made of durable, wear-resistant, and pressure-resistant material, while the portion in contact with the heat or cold reservoir can be made of a conductive material. In FIG. 8, cap 22 is formed of two segments. Segment **22*a* helps form cavity 88, while segment 22*b*, on the end of cap 22 can be made of a conductive material to enhance the cooling of chamber 14**.

Figure 9:
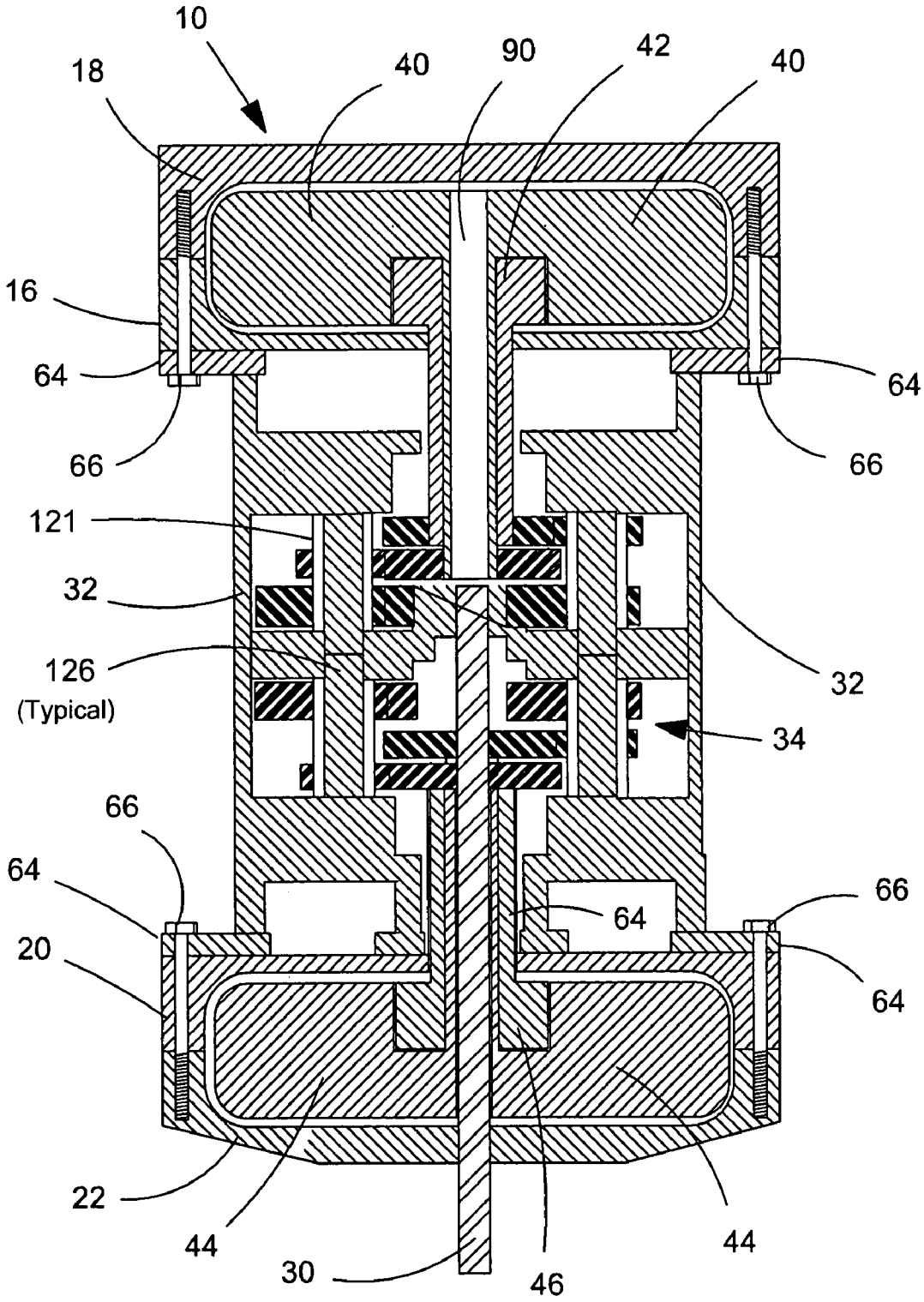
FIG. 9 is a cross-sectional view of the engine shown in FIG. 2 along lines 9-9.

FIG. 9 is a cross-sectional view of the engine shown in FIG. 2 along lines 9-9. The shapes of cavities 68 and 88 and rotors 40 and 42 and 44 and 46, respectively, are generally complimentary. It should be understood that cavities 68 and 88 and rotors 40 and 42 and 44 and 46 are not limited to any particular shape or configuration. In some aspects, the size and shape of cavity 68 and rotors 40 and 42 match the size and shape of cavity 88 and rotors 44 and 46. However, it should be understood that different sizes or shapes for cavity 68 and rotors 40 and 42 and cavity 88 and rotors 44 and 46 respectively, are possible. In some aspects, rotors 40 and 44 include opening 90 parallel to a longitudinal axis (not shown) for each shaft. In some aspects, drive shaft 30 is inserted through opening 90, for example, through opening 90 in rotor 44, to engage gear train 36.

Figure 10:
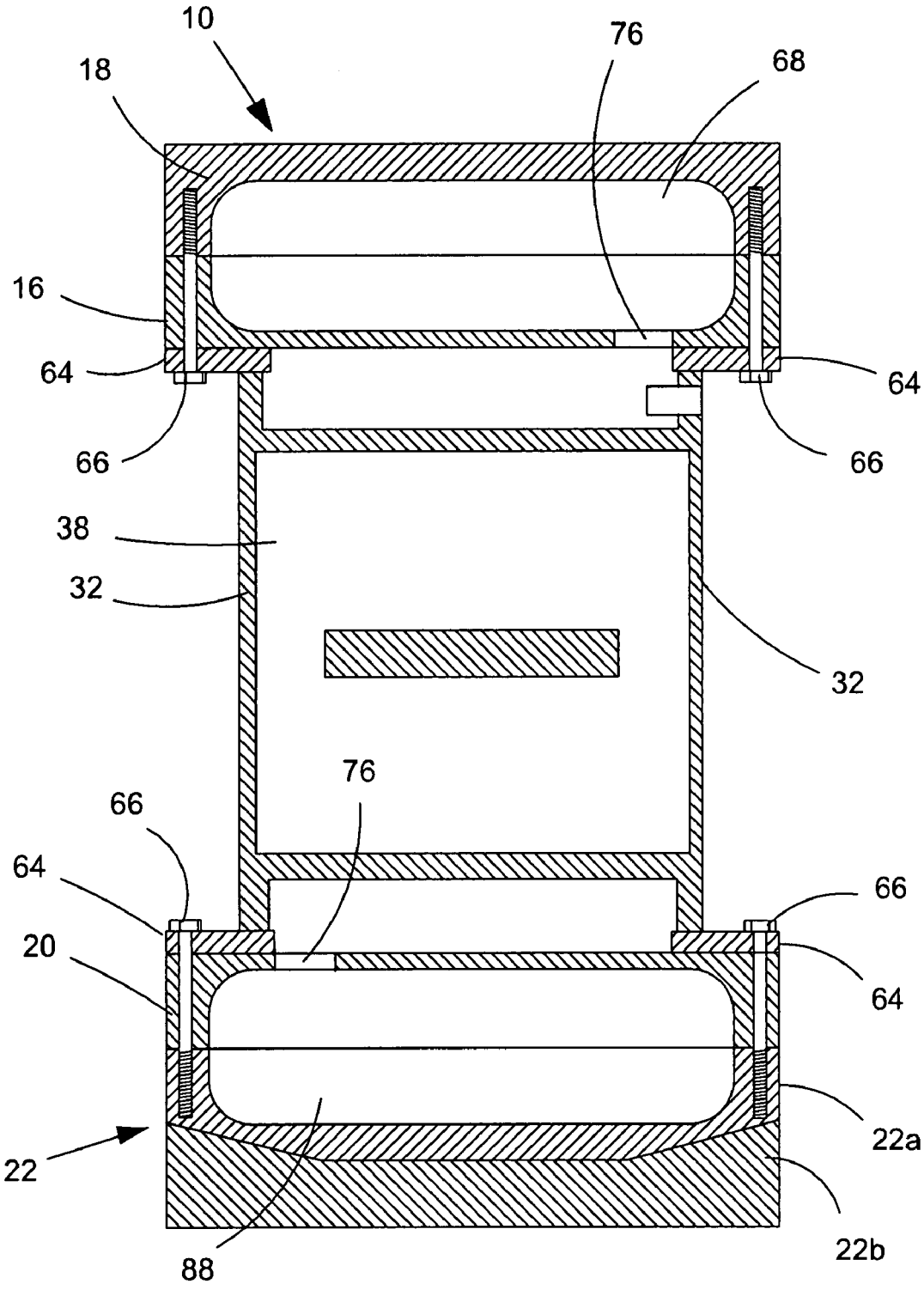
FIG. 10 is a cross-sectional view of the engine shown in FIG. 2 along lines 10-10.

FIG. 10 is a cross-sectional view of the engine shown in FIG. 2 along lines 10-10.

Figure 11:
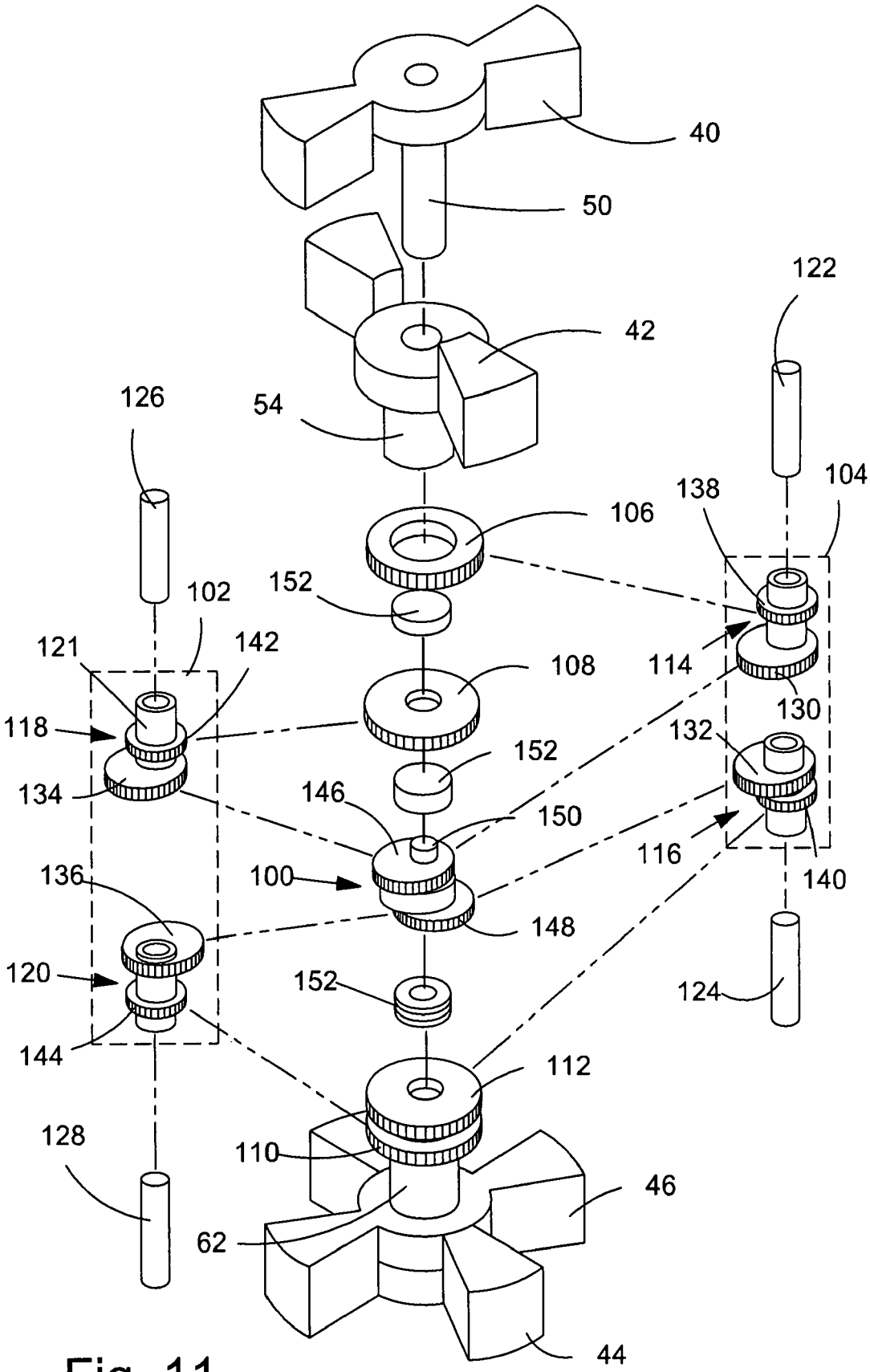
FIG. 11 is an exploded view of the gear train shown in FIG. 3.

FIG. 11 is an exploded view of the gear train shown in FIG. 3. In general, gear train 36 includes center gear group 100, outer gear group 102, and outer gear group 104. In general, gear train 36 contains a plurality of non-round gears. Non-round gears can be elliptical, oval, or any shape known in the art. For example, oval gears that produce a specific cycle per revolution ratio can be used. Standard elliptical and oval gears can be used, although specially designed gears maybe used to optimize the cycles. In general, elliptical gears have the axis at one focus and are dynamically balanced. Oval gears, which are ellipses with the axis at the center, allow the use of rotors with more than two sides. In FIG. 11, elliptical gears are used as the non-round gears. Groups 102 and 104 are opposed with respect to group 100, that is, groups 102 and 104 are symmetrically located on either side of center group 100. By positioning groups 102 and 104 in opposing positions, gear train 100 is balanced and undesirable vibrations associated with one-sided gear arrangements are eliminated. The opposed outer gear groups also enable the gear train to be compactly installed within housing 32.

Rotor round gears 106 and 108 are mounted on shafts 54 and 50, respectively. Rotor round gears 110 and 112 are mounted on shafts 62 and 58, respectively. The respective rotor round gears are used to rotate the rotors within the chambers. In some aspects, groups 102 and 104 each include two pairs of gears and in each pair one gear is non-round. In some aspects, each pair is mounted to a separate outer gear shaft. In some aspects, the mounted gears rotate about the respective outer gear shaft. Thus, pairs 114, 116, 118, and 120 are mounted to stems 121, which in turn are mounted over shafts 122, 124, 126, and 128, respectively. Stems 121 rotate about the shafts as the respective gears rotate. In the embodiment shown, pairs 114, 116, 118, and 120 include outboard elliptical gears 130, 132, 134, and 136, respectively and outboard round gears 138, 140, 142, and 144, respectively. Group 100 includes center elliptical gears 146 and 148, which are fixedly mounted to shaft 150. That is, shaft 150 rotates responsive to gears 146 and 148 and gears 146 and 148 rotate together. For drive systems that use gears to the side to drive the system (not shown), an idler gear (not shown) is placed on an outboard shaft.

Bearing packs 152 are used to hold shaft 150 in position. Housing 32 is configured to hold the bearing packs. Bearing packs 152 also provide rotating support for rotor shafts 50, 54, 58, 62. It should be understood that other arrangements known in the art can be used to support and enable rotation of the rotors and group 100 and that such arrangements are included within the spirit and scope of the claims. Spacers and any other means known in the art can be used to align the component gears in the gear train.

The following should be viewed in light of FIGS. 1 through 11. The following description is for chamber 12 and rotors 40 and 42, however, it should be understood that the description is applicable to chamber 14 and rotors 44 and 46 as well. Gear train 34 is used to produce an rotation of rotor 40 with respect to rotor 42. As a result, cyclically varying volumes are created for spaces 70. That is, the tangential distances between lobes 48 and 52, for example, distance 154, varies. Alternately stated and as shown, gear train 34 is arranged to move lobes 48 and 52 in opposing directions to increase and decrease the volumes for spaces 70 and 71. Gear train 34 uses pairs of elliptical gears, for example gears 130 and 146 to produce one cycle per rotation motion. Pairs of round gears, for example, gears 106 and 138 provide the two cycles per rotation that are needed for the embodiment shown, which completes two thermodynamic cycles per revolution of the rotors.

The phasing between rotors, for example, rotors 40 and 42 is a key to creating an efficient thermodynamic cycle. The pairs of rotors shown in FIG. 3 each has a cycling rotational velocity to create the periodically varying volume between the respective rotors by use of the elliptical gears. The phase difference between chambers 12 and 14 creates expansions and compressions of the working fluid at different times so that the working fluid is moved from one chamber, for example, chamber 12, thought regenerators 36 to the opposite chamber, for example, chamber 14, to create the thermodynamic cycle. The number of independent thermodynamic cycles for each chamber is a function of at least the number of rotors, lobes, and ports in the chambers, the number of regenerators in the engine, and the ratios in the gear train. For example, the embodiment shown has two pairs of rotors and each rotor has two lobes. Further, there are two pairs of ports in each chamber, there are two regenerators, and the gear train provides two cycles per rotor revolution. Therefore, two opposing sets of compression spaces, each of which supports an independent thermodynamic cycle, are created and each set completes two cycles per rotor revolution. Each space in an opposing set is in the same cycle and phase and as the volume for one set is expanding, the volume for the other set is contracting. Thus, complimentary phases are occurring among the sets of spaces. For example, as spaces 70 are expelling fluid to chamber 14, spaces 71 are receiving fluid from chamber 14. The embodiment shown is a paired arrangement. There is a pair of chambers (compression and expansion), a pair of regenerators 36, and a pair of outboard gear groups.

Regenerators 36 are isolated from chamber 12 and 14 during the compression and expansion phases due to the blocking action of the rotor lobes. As noted above, the efficiency of the engine is directly related to the volume changes in the working fluid during the compression and expansion phases. Thus, the present invention concentrates the available compression and expansion forces in chambers 12 and 14 on just the fluids in the chambers, creating a larger change in volume in these fluids than would be possible if the compression and expansion forces were also applied to the fluid in regenerators 36. Since chamber 12 and 14 are isolated from regenerators 36 during the compression and expansion phases, the volume of the regenerators does not need to be undesirably small to increase efficiency in the chambers. Thus, as described above, the volume of low pressure connections 84 can be made relatively large to allow both expansion chambers to simultaneously discharge into connections 84 and to enhance thermal transfer from the fluid to the wall of connections 84 without the drawback of decreasing the volume change occurring during the compression phase.

A present invention engine can be configured to rotate within a fixed base (not shown). For example, flanges 68 can be mounted to a bearing race connected to a fixed bearing race. The first bearing race is then attached to a gear or drive belt, enabling engine 10 to be rotated or to rotate within the bearing race arrangement. The drive system for the preceding arrangement can use one or more gears meshed with the rotor round gears and mounted on outboard shafts. These gears are meshed with a planetary gear surrounding the engine. Thus, as the engine rotates, the drive system rotates the elliptical gears. The gears linking the engine to the planetary gear can be stepped with additional gears to step down the ratio of engine rotation to rotor rotation. Multiple engines can be connected to a single power shaft or be powered by a single shaft (not shown). Engines also can be configured in series (not shown) to create a larger change in heat energy than would be possible using only one stage of a single engine. Engines installed in groups can be configured to counter rotate, balancing the torque effect of the group. Torque of a drive system also can be balanced with a device or the weighting of the device. In some aspects, separate gears are used for chambers 12 and 14 (not shown), enabling the phase angle between the chambers to be changed. For example, actuators can rotate planetary gears to effect the phase angle change. In some aspects (not shown), housing 32 includes an enclosed gear section to enable lubrication of gear train 34. Lubricant can be circulated for heat flow within the section and regenerators 36 can be insulated as desired. In some aspects, caps 18 or 22 can include flow tubes (not shown) to enhance heating or cooling in the respective chamber. Also, the ends of the caps may be shaped to enhance air flow or thermal transmission.

Figure 12:
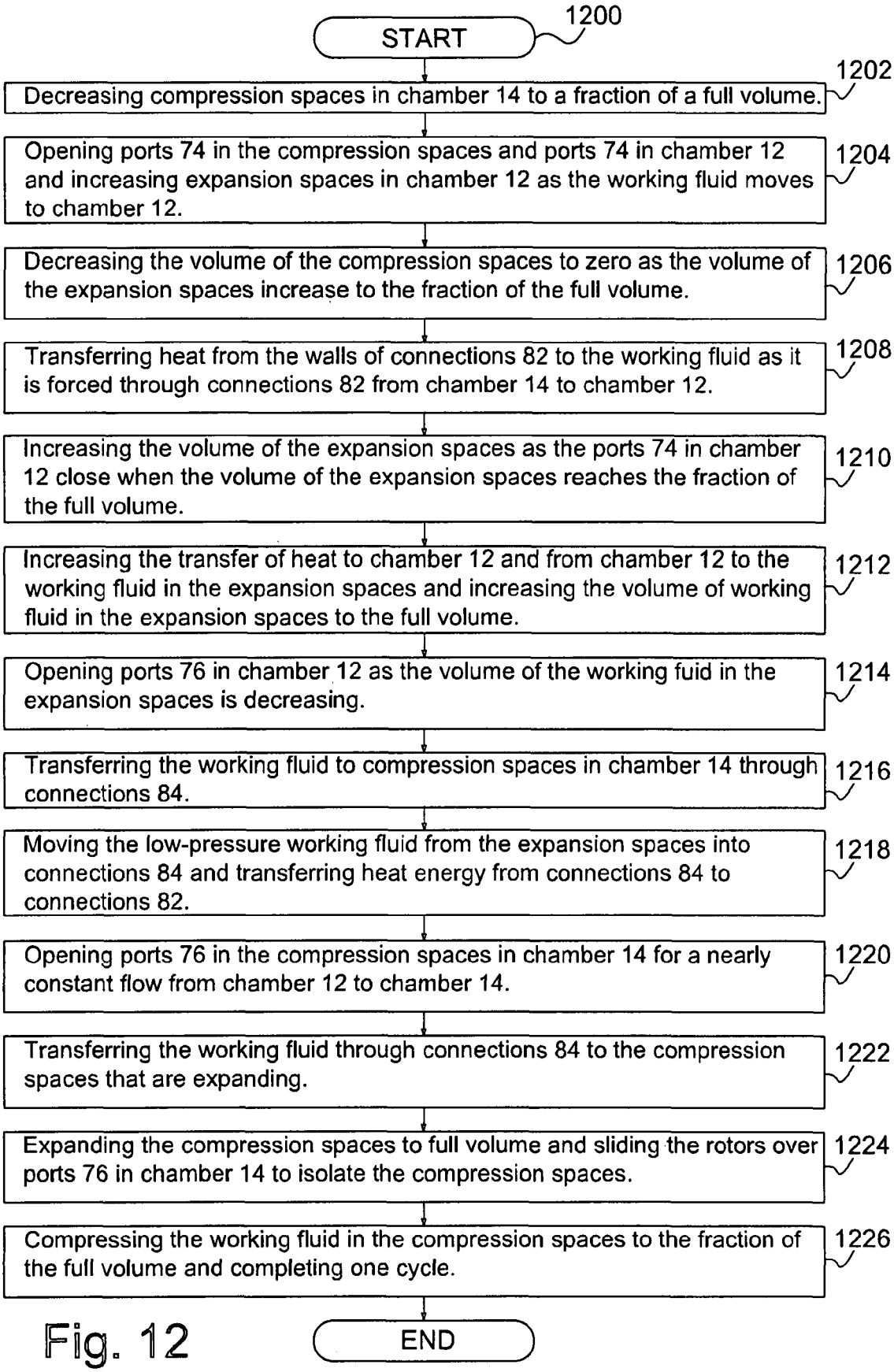
FIG. 12 is a flow chart illustrating a thermodynamic cycle in a present invention engine.

FIG. 12 is a flow chart illustrating a thermodynamic cycle in a present invention engine. Although the method in FIG. 12 is depicted as a sequence of numbered steps for clarity, no order should be inferred from the numbering unless explicitly stated. The phasing described below is for a Stirling Cycle. It should be understood that other phasing may be used and that the gears and phases between the chambers 12 and 14 need not be symmetrical. Gear train 34 can be modified so that the drive system for the chambers is changed, either dynamically or statically, to change the phase relations and thus the compression, transfer, and expansion associated with the two chambers. The method starts at Step 1200. Step 1202 decreases the volume of compression spaces in chamber 14 to a fraction of a full volume. This compression is isolated from the regenerator since the compression takes place in an area of the chamber that does not have port openings (that is, rotors 44 and 46 are blocking ports 74 and 76). Step 1204 opens ports 74 in the compression spaces in chamber 14 and ports 74 in chamber 12. Then, the volume of the expansion spaces associated with the open ports 74 in chamber 12 increases from zero as the working fluid moves from chamber 14 to chamber 12. Step 1206 decreases the volume of the compression spaces to zero as the volume of the expansion spaces increases to the fraction of a full volume. This is an essentially constant volume transfer from chamber 14 to chamber 12 through connection 82. Step 1208 transfers heat from the walls of connection 82 to the working fluid as the working fluid is forced through connection 82 from chamber 14 to chamber 12. Step 1210 closes the ports 74 in chamber 12 when the volume of the expansion spaces reaches the fraction of a full volume. The volume of the expansions spaces continues to increase. Step 1212 transfers heat to cap 18 from the heat reservoir and from cap 18 to the working fluid in the expansion spaces. The volume of working fluid in the expansion spaces increases to the full volume. Step 1214 opens ports 76 to expansion spaces in chamber 12 as the volume of the working fluid in the expansion spaces is decreasing. Step 1216 transfers the working fluid to the compression spaces through connection 84. The flow from chamber 14 to chamber 12 is intermittent due to the compression and expansion cycles being isolated from the regenerators. This isolation is a result of the rotors passing over the ports. Step 1218 moves the low-pressure working fluid from the expansion spaces into connections 84 and transfers heat energy from connections 84 to connections 82. Step 1220 opens ports 76 in chamber 14. Flow from both sets of expansion spaces in chamber 12 overlap into connections 84. The flow from chamber 12 to chamber 14 is nearly constant. Step 1222 transfers the working fluid through connection 84 to the compression spaces, which is expanding. Step 1224 expands the compression spaces to full volume and then the rotors slide over port 76 to isolate the compression spaces. Step 1226 compresses the working fluid in the compression spaces to the fraction of the full volume and completes one cycle.

Figure 13:
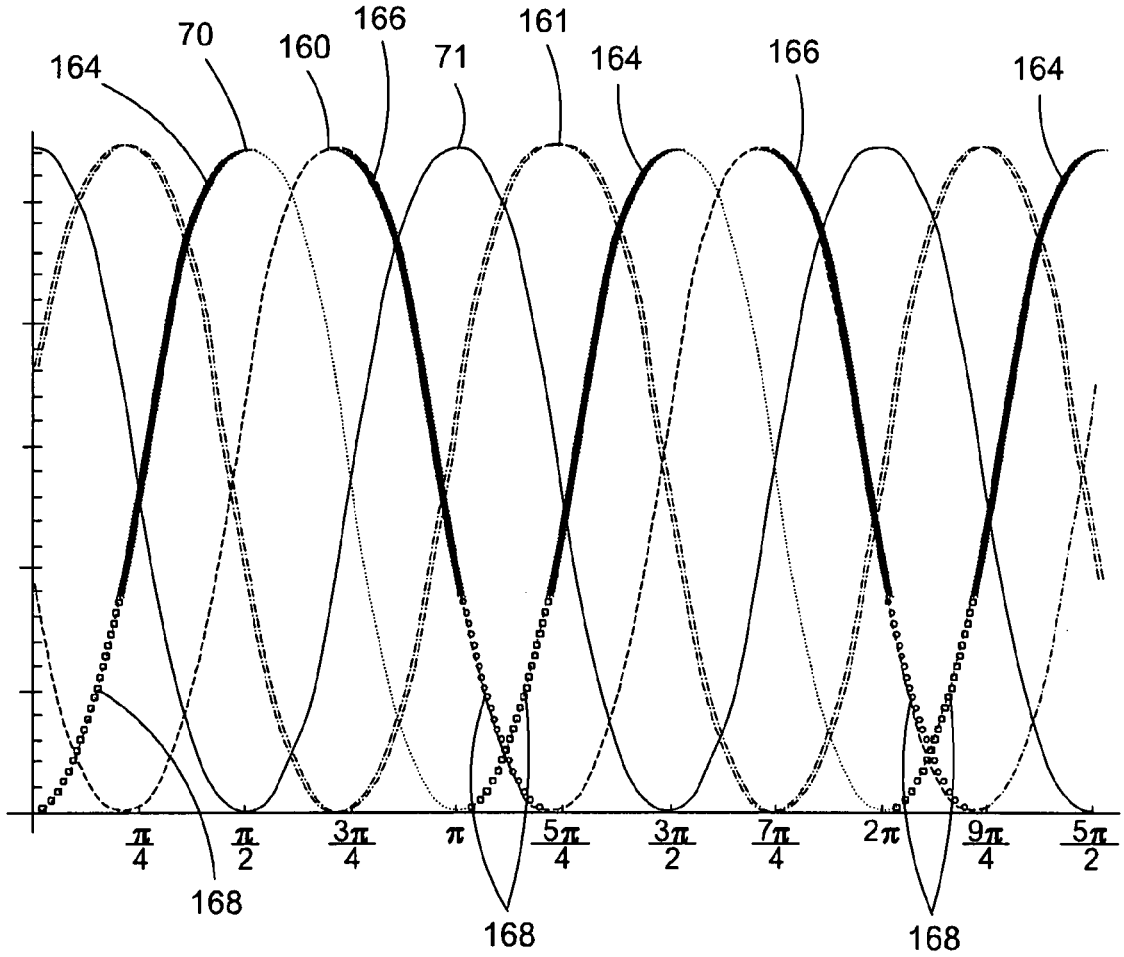
FIG. 13 is a graph showing compression and expansion cycles in a present invention engine.

FIG. 13 is a graph showing compression and expansion cycles in engine 10. The vertical axis for FIG. 13 is a unit less measure of volume. The horizontal axis is rotation of the rotors in radians. Rotors 40 and 42 form a pair of expansion spaces 70 and 71 in chamber 12. In a similar manner, rotors 44 and 46 form a pair of compression spaces 160 and 161 (not shown) in chamber 14. Volume changes for each of the pairs of expansion and compression spaces as the respective rotors rotate are shown in FIG. 13. The waveform corresponding to a particular pair of spaces is labeled with the number for that pair. The volumes vary in a sinusoidal manner between essentially zero (when opposing lobes are in contact) and a maximum value (when opposing lobes are at a maximum distance apart). The bold sections of the graph follow one cycle through compression in chamber 14 and expansion in chamber 12. That is, the bold sections follow the progress of a particular volume of fluid through engine 10. For example, sections 164 show the expansion of the fluid in spaces 70 and sections 166 show the compression of the fluid in spaces 160. The fluid moves in a cyclical manner between spaces 70 and 160. The dotted lines 168 represent the high pressure transfer of fluid from spaces 160 to spaces 70 through connector 82.

Figure 14:
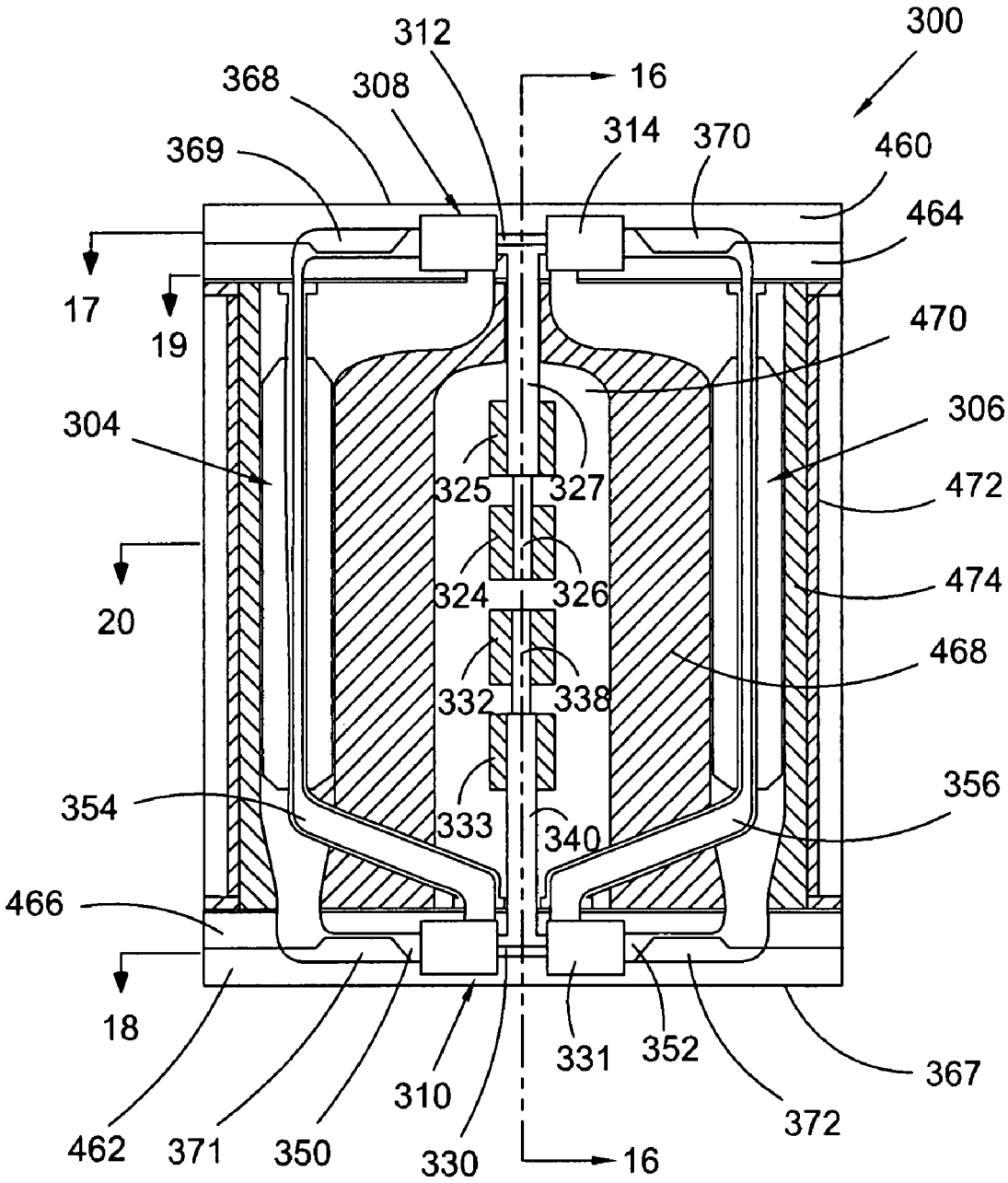
FIG. 14 is a cross-sectional view of a present invention engine with direct driving of the rotors.

FIG. 14 is a cross-sectional view of present invention engine 300 with direct driving of the rotors.

Figure 15:
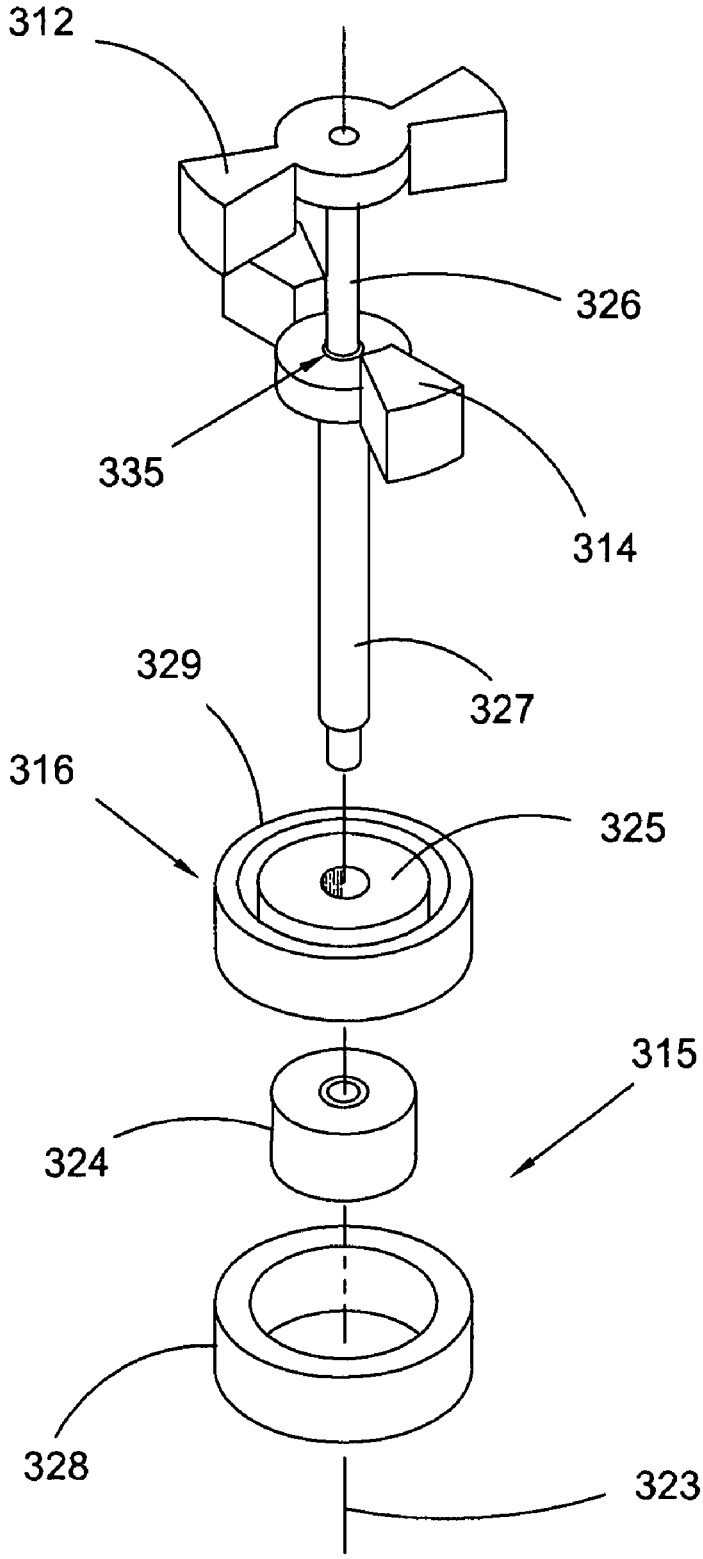
FIG. 15 is an exploded perspective view of the upper rotors and actuators shown in FIG. 14.

FIG. 15 is an exploded perspective view of the upper rotors and actuators shown in FIG. 14.

Figure 16:
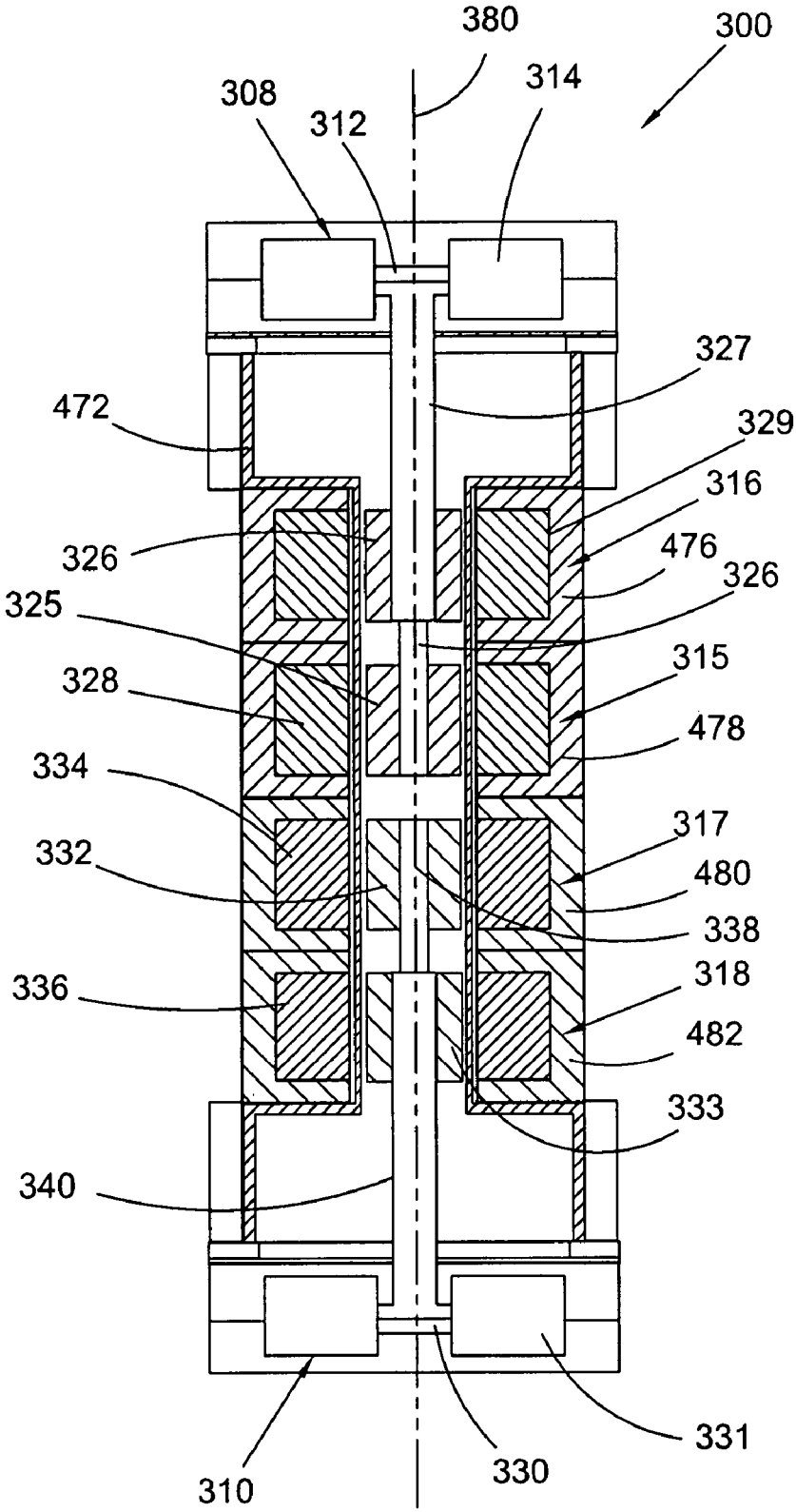
FIG. 16 is a cross-sectional view of the engine shown in FIG. 14 generally along line 16-16 in FIG. 14.

FIG. 16 is a cross-sectional view of engine 300 shown in FIG. 14, showing only the chambers, rotors, and actuators.

Figure 17:
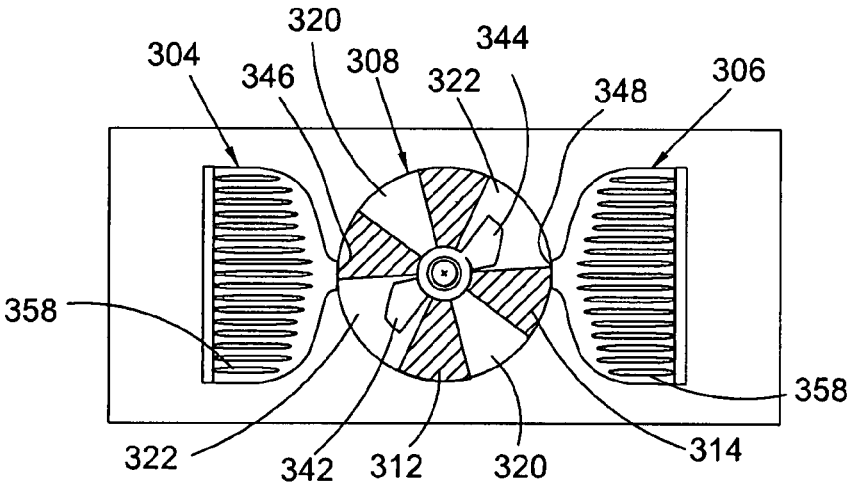
FIG. 17 is a cross-sectional view of the engine shown in FIG. 14, generally along line 17 in FIG. 14.

FIG. 17 is a cross-sectional view of engine 300 shown in FIG. 14, generally along line 17 in FIG. 14.

Figure 18:
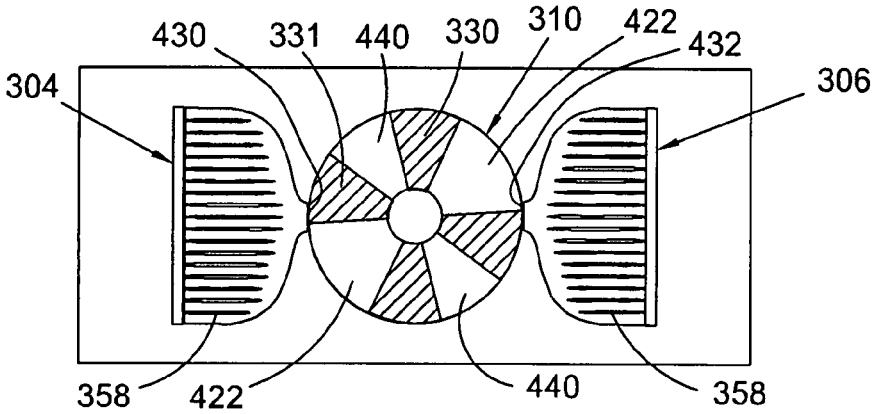
FIG. 18 is a cross-sectional view of the engine shown in FIG. 14, generally along line 18 in FIG. 14.

FIG. 18 is a cross-sectional view of engine 300 shown in FIG. 14, generally along line 18 in FIG. 14. The following should be viewed in light of FIGS. 14 through 18. To simplify the presentation, single lines are used in some portions of the figures, for example, to represent the interface of rotors and chamber walls. However, the configuration and function of engine 300 is clearly shown with these representations. The rotors of a present invention thermodynamic cycle heat engine are directly driven by an actuator, rather than being driven via a gear train, such as reference indicator 34 in FIG. 3. The configuration of engine 300 is in some ways similar to the configuration of the engine (reference designator 10) shown and described in FIGS. 1-11. However, there are significant differences between engines 10 and 300 as described infra. Engine 300 includes regenerators 304 and 306, upper chamber 308, lower chamber 310, rotors 312 and 314 in chamber 308, and actuators 315 through 318. Chambers 308 and 310 are in fluid communication with regenerators 304 and 306. Rotors 312 and 314 are disposed in chamber 308. The rotors form pairs 320 and 322 of spaces in chamber 308. The regenerators and chambers form a closed space for a working fluid (not shown). A bi-directional regenerator is described supra. It should be understood that a present invention bi-directional regenerator differs from a traditional regenerator at least because of the high and low pressure paths through the bi-directional regenerator and the subsequent increase in heat exchange enabled by the paths.

The actuators in engine 300 are directly connected to the respective rotors. By directly connected, we mean that at least a portion of the actuator is fixedly secured to the respective rotor. For example, actuators 315 and 316 are directly connected to rotors 312 and 314, respectively. That is, there is no relative rotational movement between the rotary drive component of the actuators and the respective rotors. Alternately stated, there is a torque path, or torque transfer path, between a respective actuator and rotors and the torque path is fixed with respect to the rotary drive component of the respective actuator and the rotors. That is, there are no intermediate moving parts, such as belts or gears, between the actuators and the rotors.

Actuator 315 is arranged to displace rotor 312 about axis of rotation 323 for the rotors and actuator 316 is arranged to displace rotor 314 about axis of rotation 323. The actuators are located outside of the chambers and rotate and displace the rotors in a manner similar to that described for gear train 34 in FIGS. 1-11, except as noted below. In some aspects, actuators 315 and 316 are electric motors. In some aspects, the motors have inner motor sections, or portions, 324 and 325, respectively, which are directly connected to the rotors, for example, to shafts 326 and 327, respectively, of the rotors, advantageously eliminating the need for a gear train between the actuators and the rotors. Outer motor portions 328 and 329 of motors 315 and 316, respectively, are fixed about axis of rotation 323. Advantageously, the use of split section motors enables the motor (each inner and outer motor section) to be completely sealed. For example, the motors do not include a drive shaft, extending from the interior of the motor that would require a more difficult to implement and expensive rotary seal and that would be more prone to leaking. The sealing configuration shown for engine 300 is particularly important when fluids such as helium as used as the working fluid in the engine. To displace the rotors, the motors are energized such that respective magnetic fields cause the respective inner sections to rotate with respect to the respective fixed outer sections, rotating the rotors to which the inner sections are connected. It should be understood that the inner and outer motor sections can be configured and arranged in any way known in the art.

By directly connecting actuators and rotors, a quicker response of the rotors is possible, inefficiencies associated with an intermediate drive train are eliminated, and space is saved in the engine. The space savings can be used to expand the size of the regenerators or add further features to increase the engine efficiency as described below, or can be used to reduce the overall size and weight of the engine.

In some aspects, the shafts are at least partially disposed one within the other. For example, shaft 326 is at least partially disposed within shaft 327. That is, shaft 327 includes a cylindrical space 335 through which shaft 326 extends and within which shaft 326 is rotatable.

Engine 300 also includes rotor 330 disposed in chamber 310 and rotor 331 also disposed in chamber 310. The configuration and operation for the rotors in chamber 310 is substantially the same as that of the rotors in chamber 308. For example, in some aspects, actuators 317 and 318 are electric motors and include inner motor sections 332 and 333 and outer motor sections 334 and 336, respectively. Shafts 338 and 340 of rotors 330 and 331, respectively, are connected to sections 332 and 333, respectively. Further, shaft 338 is disposed within shaft 340. The operation of actuators 317 and 318 and rotors 330 and 331 is as described for actuators 315 and 316 and rotors 312 and 314.

The operation of engine 300 is now described in further detail. The general operation of engine 300 is substantially the same as the general operation of engine 10 described in FIGS. 1-11, except as noted. For example, the general compression and expansion cycles and associated relative rotational displacement of the rotors in the respective chambers for engine 300 is substantially as described for engine 10. However, it should be understood that other cycles, displacements, and phasing are included in the spirit and scope of the claimed invention. In the discussion that follows, chamber 308 is used to describe the function of engine 300, however, it should be understood that the description of the function of chamber 308 also is applicable to the function of chamber 310.

Figure 19:
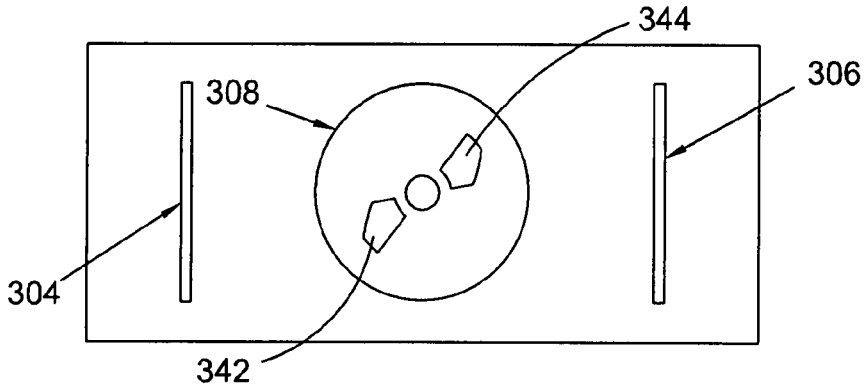
FIG. 19 is a cross-sectional view of the engine shown in FIG. 14, generally along line 19 in FIG. 14.

FIG. 19 is a cross-sectional view of engine 300 shown in FIG. 14, generally along line 19 in FIG. 14.

Figure 20:
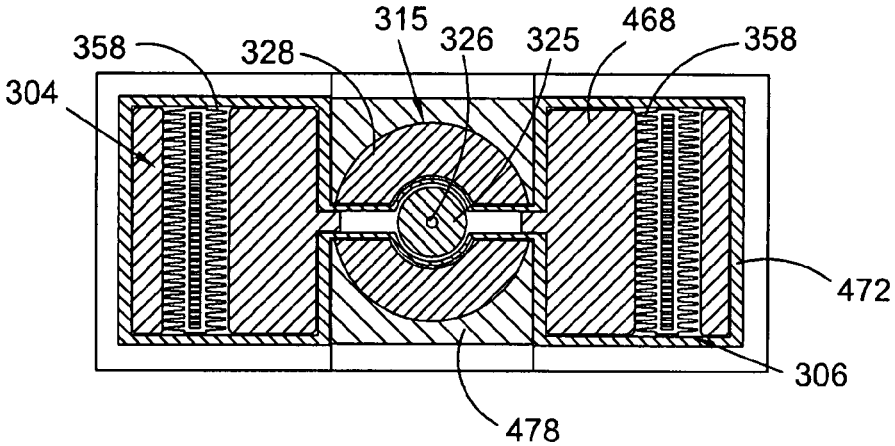
FIG. 20 is a cross-sectional view of the engine shown in FIG. 14, generally along line 20 in FIG. 19.

FIG. 20 is a cross-sectional view of engine 300 shown in FIG. 14, generally along line 20 in FIG. 14. The following should be viewed in light of FIGS. 14 through 20. To simplify the presentation, single lines are used in some portions of FIGS. 19 and 20, for example, to represent the walls of the chambers. However, the configuration and function of engine 300 is clearly shown with these representations.

Low pressure ports 342 and 344 are similar to the low pressure ports shown in FIGS. 1-11. In some aspects, unlike the high pressure ports shown in FIGS. 1-11, high pressure ports 346 and 348 are located in the walls of chamber 308. Ports 342 and 344 are connected to low pressure channels 350 and 352, respectively, and ports 346 and 348 are connected to high pressure channels 354 and 356, respectively. Channels 350 and 354 are connected to, that is, in fluid communication with, regenerator 304 and channels 352 and 356 are connected to regenerator 306. The flow of the working fluid through the ports and regenerators is substantially as described for FIGS. 1-11, except as noted. In some aspects, regenerators 304 and 306 include fins 358 which are connected to high pressure passages 354 and 356, respectively, and extend into low pressure passages 350 and 352, respectively. Fins 358 accelerate and enhance heat exchange between respective high and low pressure passages. By fins we means any structure or functionality that increases surface area and hence heat exchange for a heat exchanger. It should be understood that a fin in a present invention engine is not limited to the configuration shown in the figures.

For purposes of illustration, in the discussions that follow, engine 300 is configured to operate in a cooler cycle. However, it should be understood that engine 300 is not limited to only operating in a cooler cycle and that any thermodynamic modes of operation known in the art are included in the spirit and scope of the claimed invention. In a cooler application heat is removed from a source to be cooled and moved to a sink for the heat. For example, heat is removed from a heat source (not shown) to which chamber 310 (the fluid expanding side) is interfaced via chamber face 367 and expelled to a heat sink (not shown) to which chamber 308 (from the fluid compression side) is interfaced via chamber face 368. In some aspects, the expansion chamber face is in direct contact with the heat source, for example, as is done in cooling applications for electronics and sensors. In the figures, the chamber faces are substantially flat. However, it should be understood that other chamber face configurations are included in the spirit and scope of the claimed invention. In some aspects (not shown), the expansion chamber face is shaped as required to enable flow of heat containing fluid across the face or the face includes internal tubes to enable heat containing fluid to be pumped through the chamber face. These arrangements also enable the fluid to be pumped where desired, such as in refrigeration/air conditioning. In some aspects (not shown), chamber 308 includes fluid tubes in the chamber or air fins on face 368 and a fan to help sink heat.

In some aspects, engine 300 includes heat exchange capability disposed between the chambers and the regenerators, for example, heat exchangers 369, 370, 371, and 372 located in high pressure channels 354 and 356 and low pressure channels 350, and 352, respectively. Exchangers 371 and 372 are connected to chamber face 367, and augment the flow of heat from the heat source to the working fluid. Exchanger 369 and 370 are connected to chamber face 368 and augment the flow of heat from the working fluid to the heat sink.

In some aspects, a present invention engine includes one or more sensors arranged to detect respective conditions associated with operation of one or both of the chambers in the engine and a controller arranged to receive and process signals from the sensors regarding the detected conditions. Then, the actuator or actuators for the rotors in the engine are arranged to rotationally displace the rotors responsive to the detected condition or conditions. For example, the controller controls the operation of the actuators responsive to the signals from the sensors. The sensors can be used to detect any operational parameter known in the art, associated with operation of the chambers, including, but not limited to, temperature, pressure, current in the actuators for those aspects in which the actuators are electric motors, angular position of the rotors, and flow rate. The sensors and controller can be any sensors or controllers known in the art. The sensors can be configured and disposed in the engine by any means known in the art and as suitable for the particular sensor being used. The sensors are connected to the controller using any means known in the art, including hardwiring and radio frequency. In some aspects, the controller is located outside the engine. In some aspects (not shown), the controller is located inside the engine. The controller is used to control the actuators using any means known in the art, as further described infra.

The rotors in the rotor pairs are independently displaceable about the axis of rotation. In some aspects, the controller is arranged to control relative rotation of the rotors in the rotor pairs, for example, the relative rotation of rotors 312 and 314 with respect to each other. In some aspects, the controller is arranged to control the relative speed between rotors, for example, between rotors 312 and 314. In some aspects, the controller is arranged to control the circumferential spacing between rotors with respect to axis 323. That is, to control the volume of the paired spaces in the chambers, such as spaces 320 and 322 in chamber 308. In some aspects, the controller is arranged to control phasing between the rotors in the chambers, for example, between rotors 312 and 314 and rotors 330 and 331.

Figure 21:
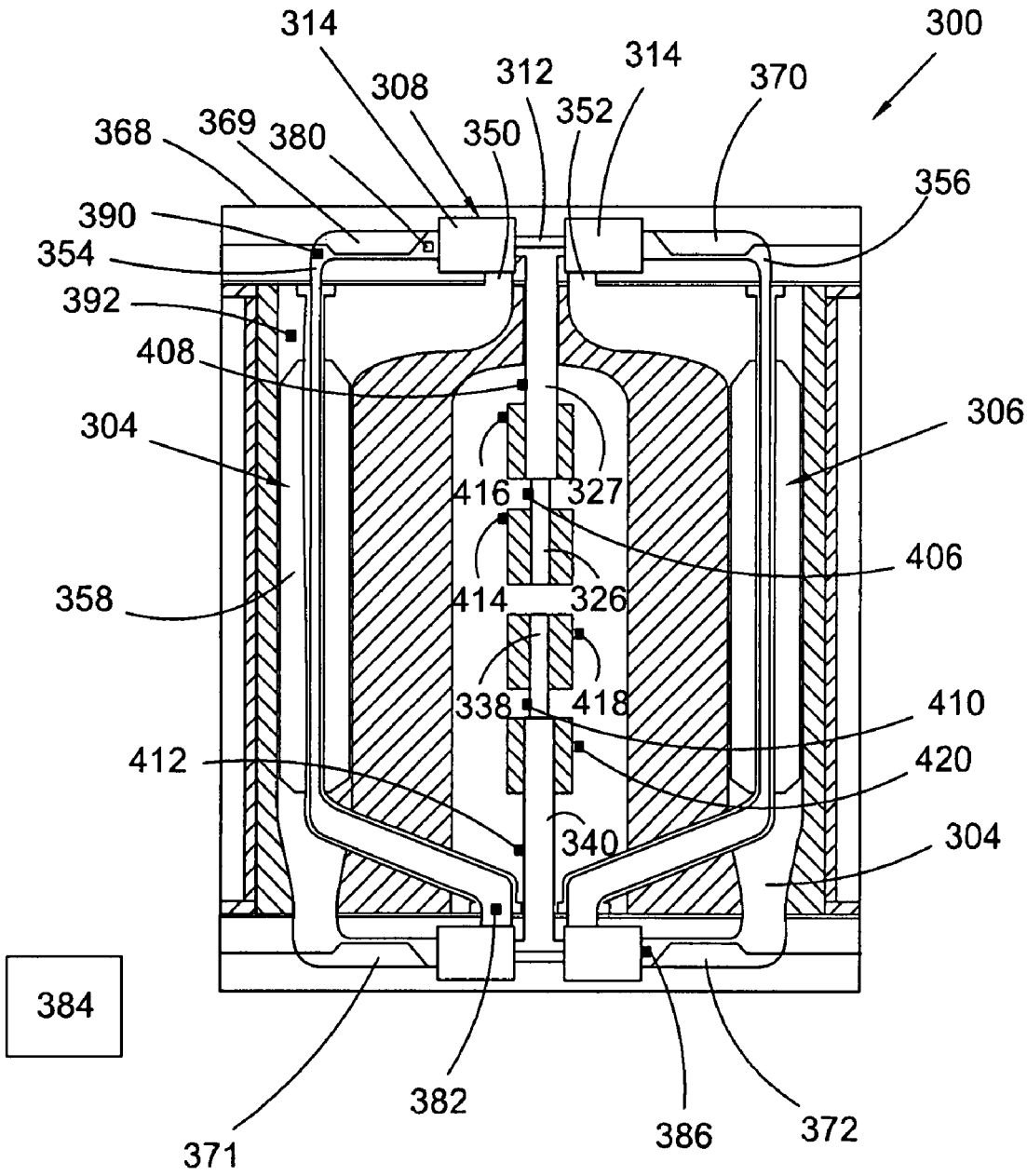
FIG. 21 is a cross-sectional view of the engine shown in FIG. 14, showing sensors.

FIG. 21 is a cross-sectional view of engine 300, showing sensors. The following should be viewed in light of FIGS. 14-21. In some aspects, engine 300 includes one or more of temperature sensors 380, 382, 384, and 386, arranged to measure temperatures associated with channels 354, 350, 356, and 352. Due to the proximity of the sensors to the chambers, the sensors provide good approximations of temperatures in the chambers.

A Stirling cycle is optimized when the compression and expansion are isothermal. For example, if the working fluid becomes warmer during compression instead of expelling heat, the engine attempts to expel too much energy through the chamber faces, for example, face 368 of chamber 308, for the compression ratio being used. In this case, the efficiency can be increased by decreasing the ratio being used. The temperature sensors can be used to detect the temperature conditions associated with the compression and expansion cycles, the controller receives signals regarding the detected conditions, and the controller can modify operation of the actuators and rotors accordingly. For example, in the case noted above, the controller can operate the actuators and rotors to reduce the compression cycle to attain a more isothermal operation of the cycle.

Figure 22:
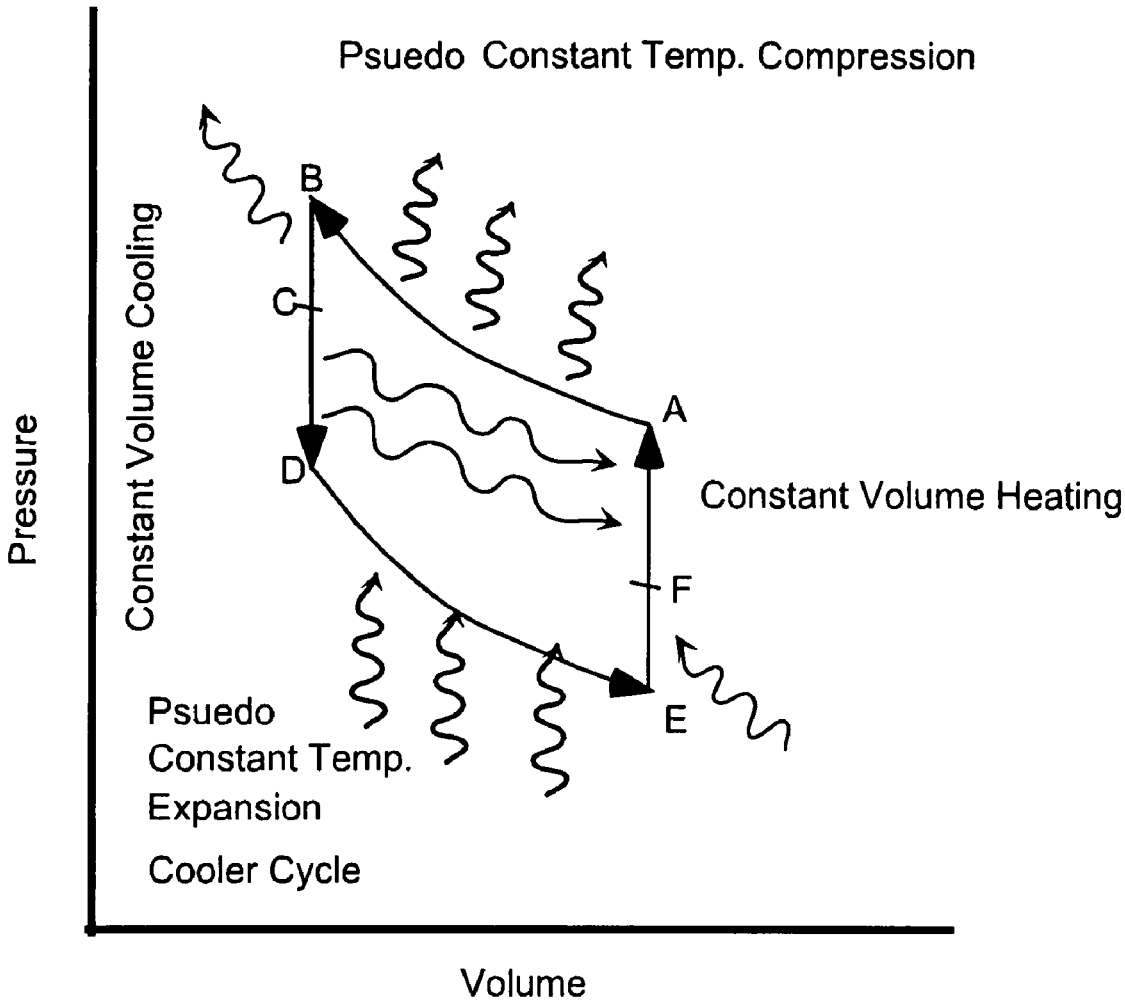
FIG. 22 is a pressure versus volume graph for the operation of the engine shown in FIG. 14 in a cooler cycle.

FIG. 22 is a pressure versus volume graph for the operation of engine 300 in a cooler cycle. The points A through F are used in the discussions below. The area enclosed by the plot in FIG. 22 is a visual representation of the efficiency of engine 300. For example, the area is proportional to the efficiency. The temperature sensors also can detect change in the flow of the working fluid through the respective high and low pressure channels. The controller can use the data from the sensors to measure the effectiveness of the regenerators. Increasing the temperature differential in the flow, increases the height of the plot in FIG. 22, thereby increasing the area of the plot and the efficiency of the engine. The efficiency of the regenerators is at least partially a function of the residency time of the working fluid inside the regenerators. The residency time is a function of the flow rate through the regenerators, which is a function of the speed of operation of the engine. Therefore, using data from the temperature sensors, the controller controls the operation of the actuators and respective rotors (speed of the engine) so that an optimum flow rate and heat exchange through the regenerator are established.

In some aspects (not shown), pressure in chambers 308 and/or 310 is directly measured, for example, by using sensors in the chambers walls. In some aspects, a close approximation to pressure in the chambers is obtained by pressure sensors in the high pressure and low pressure sections of the regenerator. For example, in some aspects, engine 300 includes one or more of pressure sensors 390 and 392 arranged to measure pressures associated with high pressure channel 354 and low pressure channel 350, respectively. The pressure sensors are used to measure pressure change through the chambers. The sensors can be any pressure sensors known in the art. The respective sensors detect respective pressures of each side of the respective chambers, for example sensors 390 and 392 detect pressure in paired chambers 320 and 322 formed within chamber 308 by the rotors. The pressure readings can be compared to evaluate the compression or expansion cycles and the effects of the heating and cooling of the heat being exchanged. One evaluation is the efficiency and effectiveness of the rotors with the clearance seals (not shown) at an operating speed. For example, if a desired compression is not achieved, the engine could be sped up or slowed down as needed. Also, the compression ratio described above can be monitored and changed using the pressure sensors.

For a given set of exterior temperatures and operating conditions, such as cooling desired and heat sinking available, and an optimum engine speed with respect to flow through the regenerators, the rotors will leak a given amount. If leakage results in an actual compression different than the desired compression, the controller can use data from the pressure sensors to detect the difference and modify the compression ratio. For example, if the desired compression is 3:1 and the rotors are only producing a 2:1 compression with a mechanical compression of 3:1, the controller can increase the mechanical compression until the desired compression is achieved.

Other control considerations associated with modification of compression ratios are as follows. Higher compression ratios can result in greater heat transfer, but the heating and cooling requirements of the rotor chambers can require lower compression ratios. Lowering compression and/or expansion ratios can reduce torque requirements for the actuators, enabling quicker accelerations, lower energy consumption for the actuators, or high speed idle. Higher compression ratios require higher torque from the actuators, enabling the actuators to be slowed or a rotor speed to be maintained. Also, this configuration increases heat carrying capacity faster than other modifications, such as changing speed (RPM) of the actuators.

In some aspects, engine 300 includes one or more of sensors 406, 408, 410, and 412, arranged to measure the angular position of shaft 326, 327, 338, and 340, respectively. The sensors can be any angular position sensors known in the art and interface with the respective shaft using any means known in the art. The respective sensors send data regarding the angular position of the shafts to the controller, which uses the feedback to control the actuators. For example, the actuators are controlled so that critical angular points, such as those associated with opening and closing ports in chambers 308 and 310 and the compression ratios (a function of the circumferential distance or spacing between rotors), are met.

In some aspects, engine 300 includes one or more of sensors 414, 416, 418, and 420, arranged to measure the torque associated with actuators 315, 316, 317, and 318, respectively. Any sensors known in the art can be used. In some aspects, the actuators are electric motors and the sensors are current sensors, interfaced with the respective motors by any means known in the art. For a given motor, applied current is equivalent to torque produced, either to the rotor from a motor or from the rotor to a generator. To meet the critical angular points noted above, respective torques can be monitored and controlled. Further, for some applications, torque applied is the best method of measuring the cooling produced. That is, the current is proportional to the cooling produced.

Figure 23A:
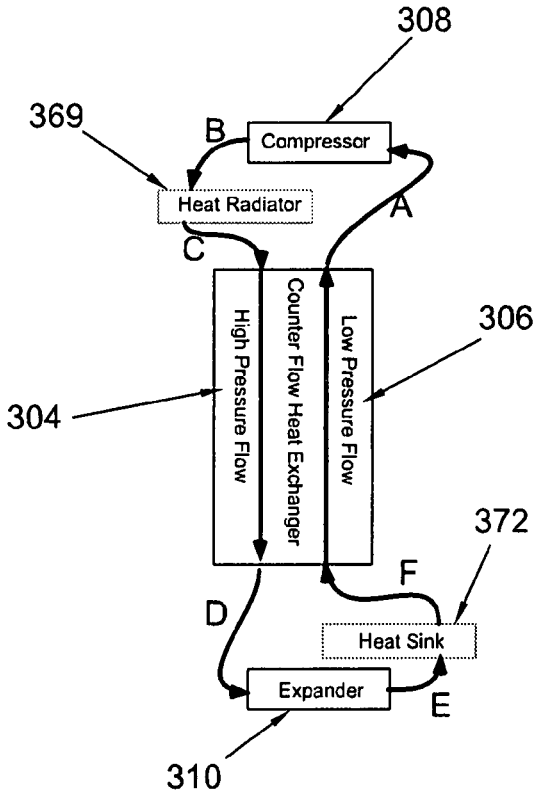
FIG. 23A is a schematic representation of working fluid flow through the engine shown in FIG. 14.

FIG. 23A is a schematic representation of working fluid flow through engine 300.

Figure 23B:
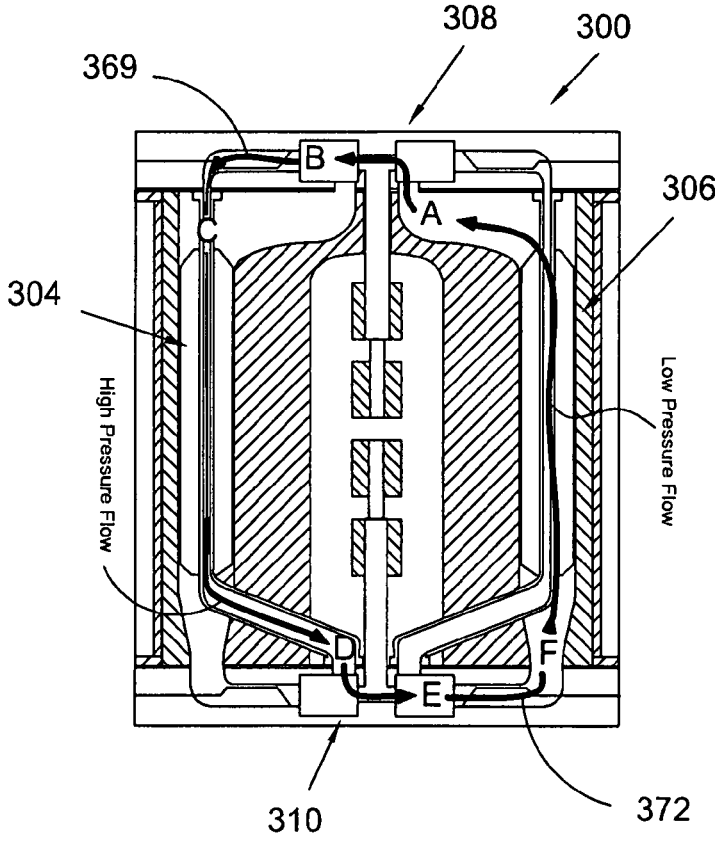
FIG. 23B shows the working fluid flow shown in FIG. 23A with respect to a cross-sectional view of the engine shown in FIG. 14.

FIG. 23B shows the working fluid flow shown in FIG. 23A with respect to a cross-sectional view of engine 300.

Figure 24:
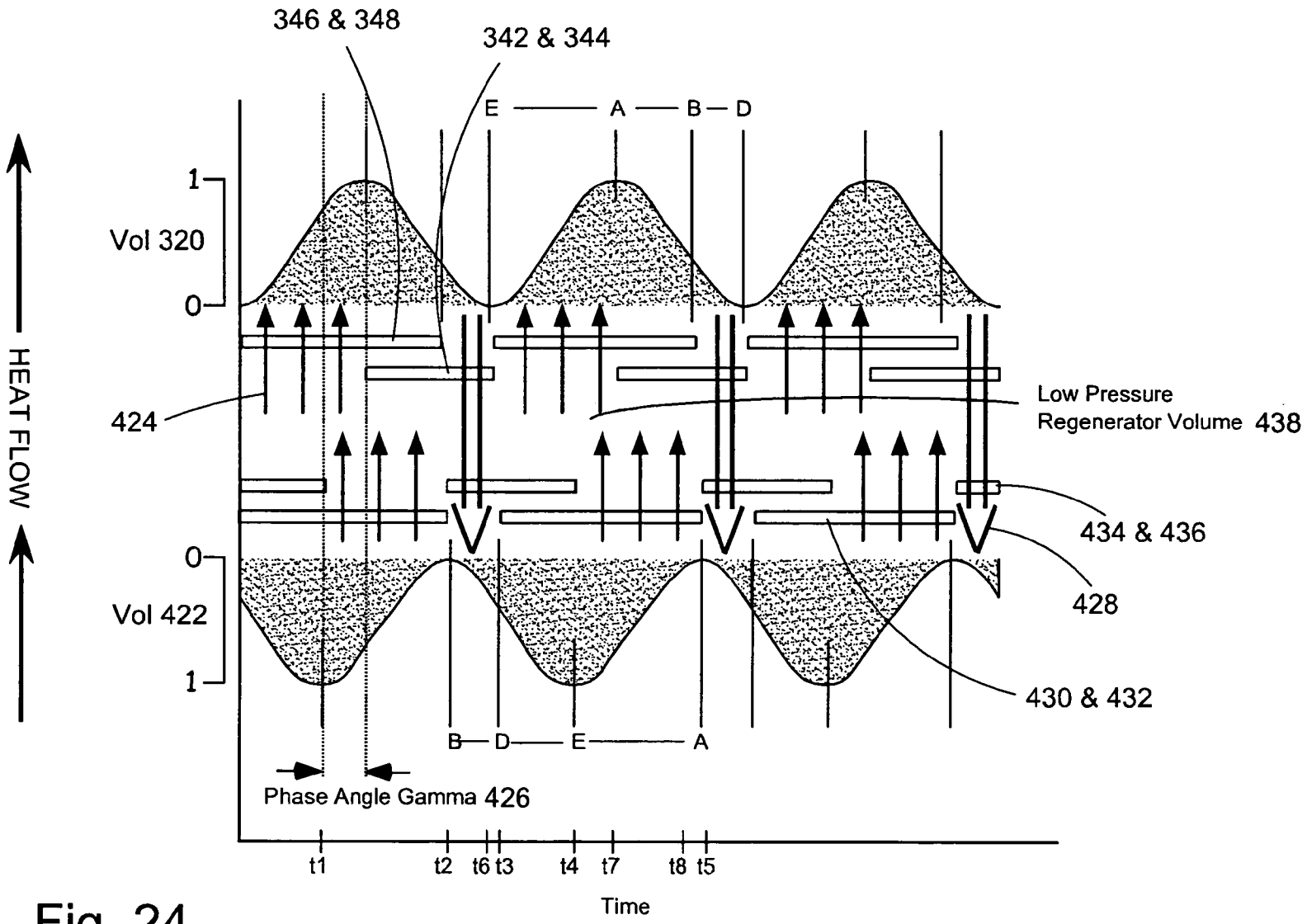
FIG. 24 is a heat flow versus time chart for paired chambers in a compression chamber and paired chambers in an expansion chamber, illustrating operation of a present invention engine.

FIG. 24 is a heat flow versus time chart for paired chambers 320 in chamber 308 and paired chambers 422 in chamber 310, illustrating operation of engine 300. The following should be viewed in light of FIGS. 14 through 24. FIG. 24 shows the volumes in chambers 320 and chambers 422 with respect to time and illustrates a number of parameters and functionalities associated with engine 300. Heat flows from chamber 310 to chamber 308. A cycle of engine 300 is shown as follows. Starting at time zero, chamber 320 has no volume (rotors 312 and 314 are in contact having expelled the fluid from chambers 320). Then, volume in both paired chambers is increased by the motors, decreasing the temperature of the fluid. Heat energy is then absorbed into the fluid from the heat source and fluid in chambers 422 and fluid in the regenerator flows to chambers 320. The phase angle gamma 426 between the rotors in the respective chambers is shown. For example, gamma represents the time difference, or phase difference, between the operations in chambers 308 and 310. Low pressure flow arrows 424 illustrate the low pressure flow from chambers 422 to chambers 320 via the low pressure side of the heat exchanger 358 of FIG. 20 and the heat exchanger 358 of FIG. 18. High pressure arrows 428 illustrate the high pressure flow from chambers 320 to chambers 422 via the heat exchanger 304 and the high pressure side of the heat exchanger 306. The overlap in the openings of respective ports are shown, which enable the pattern of flows between the paired chambers as shown. For example, between time zero and t1, the respective rotors are positioned such that chambers 320 are in fluid communication with high pressure ports 346 and 348; and chambers 422 are blocked from high pressure ports 430 and 432 and low pressure ports 434 and 436 (not otherwise shown in the figures), which are similar in configuration to ports 342 and 344. Area 438 represents the volume in regenerator 304. Thus, to follow stages of a partial cycle, high pressure transfer from chambers 322 to chambers 422 occurs between t2 and t3, expansion in chambers 422 occurs between t3 and t4, low pressure transfer from chambers 422 to regenerator 304 occurs between t4 and t5, low pressure transfer between the regenerator and chambers 320 occurs between t6 and t7, and compression in chambers 320 occurs between t7 and t8, at which point the cycle repeats.

Figure 25:
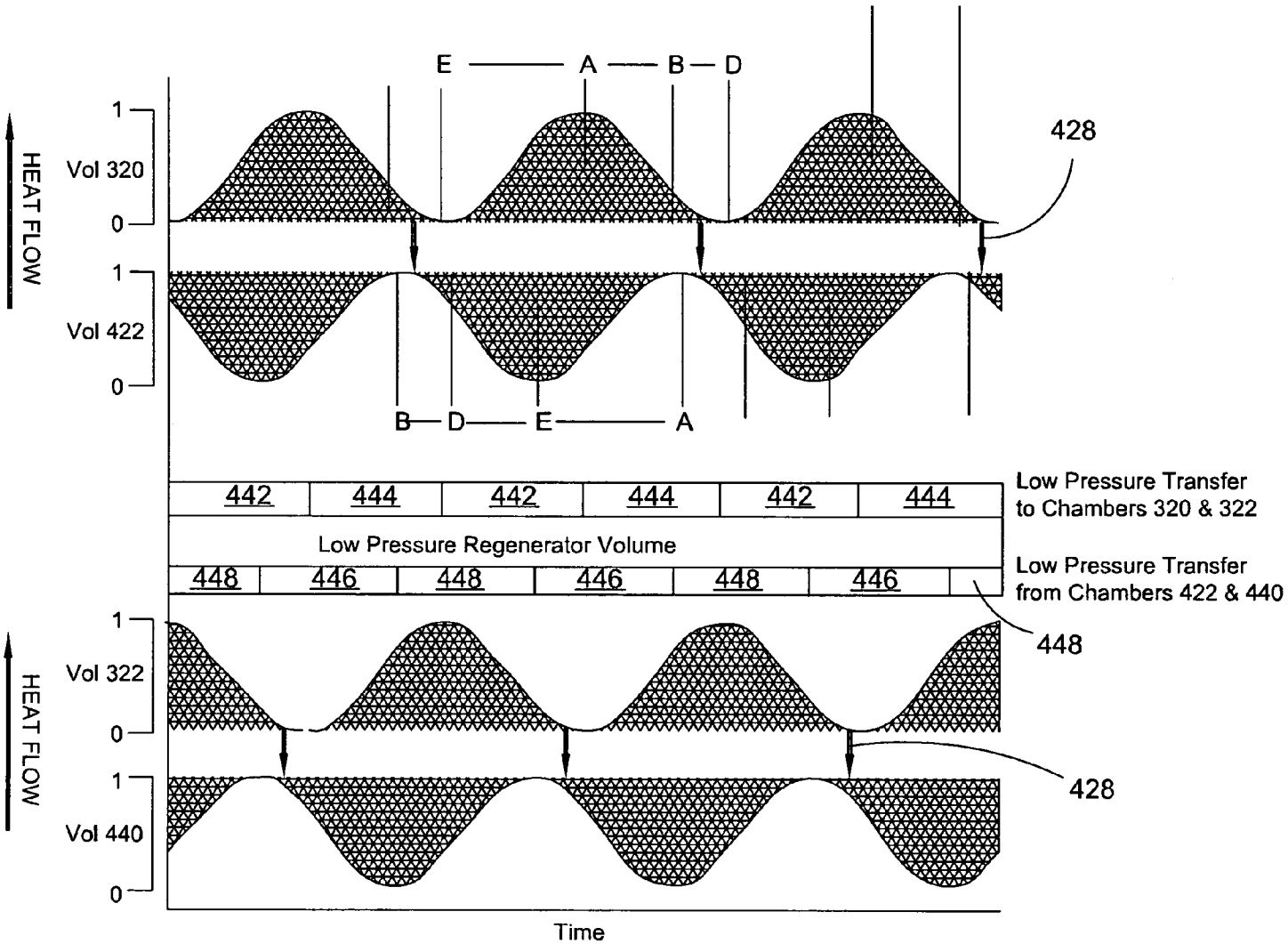
FIG. 25 is a chart of volumes for the four chamber pairs for a compression chamber and an expansion chamber, illustrating operation of a present invention engine.

FIG. 25 is a chart of volumes for the four chamber pairs for compression chamber 308 and expansion chamber 310, illustrating operation of engine 300. Indirectly, FIG. 25 also illustrates heat flow versus time for chambers 308 and 310. The following should be viewed in light of FIGS. 14 through 25. FIG. 25 shows the volumes in chambers 320, 322, 422 and 440 with respect to time. FIG. 25 shows the relative volumes of the preceding chambers, the periods of flow 442 to chambers 320, the periods of flow 444 to chambers 322, the periods of flow 446 from chambers 422, and the periods of flow 448 from chambers 440.

The points A-F shown in FIGS. 22-25 show the relative progress of a portion of the working fluid through the cooling cycles shown in the figures. FIG. 22 shows the general changes in pressure and volume for the working fluid in a cycle beginning and ending at point A. FIGS. 23A and 23B, show the location of the working fluid in engine 300 with respect to points A-F. For example, the rise in pressure and reduction of volume from points A to B in FIG. 22 relates to the compression cycle in cylinder 308 shown in FIGS. 23A and 23B. In like manner, the volume cycles shown in FIGS. 24 and 25 are correlated to FIGS. 22-23B. For example, the volume increase shown from t3 to t4 in FIG. 24 is related to cycle segments D-E, which are related to the expansion in chamber 310 as shown in FIG. 23B.

By directly connecting the actuators to a present invention engine, the curves shown in FIGS. 24 and 25 are advantageously steeper than curves for the same cycles in engine 10 in FIGS. 1-11. The slope of the curve is the rate of change in volume. The more constant the change, the closer the cycle will be to an ideal Stirling cycle. In general, the shape/steepness of the curves shown in FIGS. 24 and 25 is dependant upon the torque applied by the motors during the cycles shown in the curves. For example, increasing applied torque, for example, by using a larger or more powerful actuator, increases the slope of the curves. The direct connection of the actuators enables a more immediate change in the rotor rotation, than is possible with an intervening drive train, such as gear set 34. In addition, the use of two actuators, one controlling each side of the compressed/expanded fluid, advantageously enables quicker volume changes. In comparison, volume changes for a typical piston type system are slower since only one side of the fluid is actuated. The more immediate change (steeper slope) results in a more constant rate of fluid transfer into and out of the chambers. The extent of the constancy (steepness of the slope) is dependent upon the torque applied by the actuators.

Figure 26:
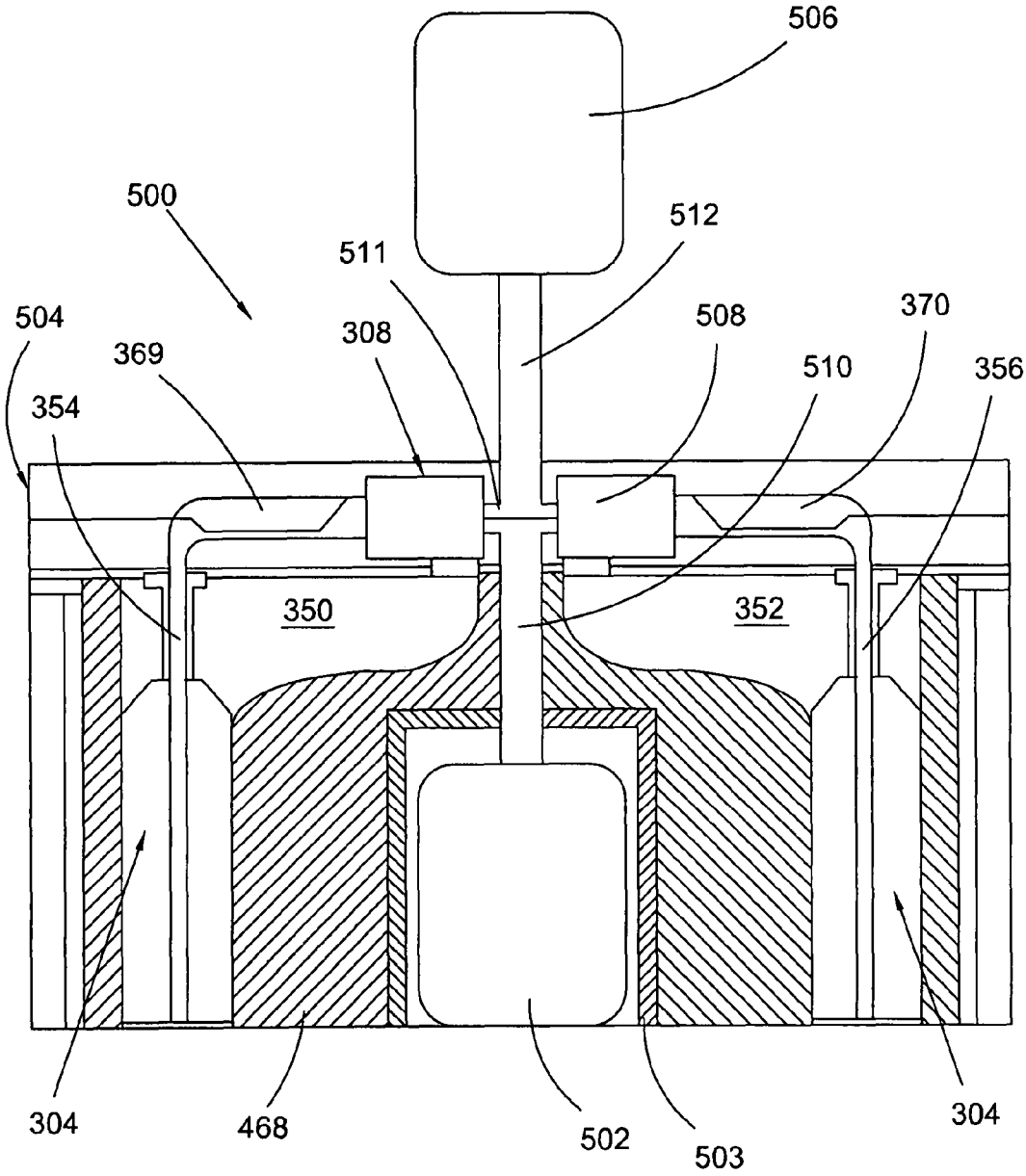
FIG. 26 is a partial cross-sectional view of a present invention engine with direct driving of the rotors.

FIG. 26 is a partial cross-sectional view of present invention engine 500 with direct driving of the rotors. In some aspects, one of more of the actuators is located outside of the shell for the engine. In FIG. 26, actuator 502 is separated from the working fluid and insulation 468 by shell wall 503 and actuator 506 is located outside of shell 504. Actuator 502 is connected to rotor pair 508 in chamber 308 by drive shaft 510. Actuator 506 is connected to rotor pair 511 (partially shown)

in chamber 308 by drive shaft 512. Shafts 510 and 512 pass through and are sealed with respect to shell wall 503 and shell 504, respectively, by any means known in the art. In some aspects, the actuators (not shown) for the rotors (not shown) for the other chamber (not shown) in engine 500 are arranged as shown for actuators 502 and 506. In some aspects, the remaining configuration and components for engine 500 are as shown and described for engine 300 and the above discussion regarding engine 300 is applicable to engine 500. For example, the discussion of the operation of actuators 315 and 316 is applicable to actuators 502 and 506.

Figure 27:
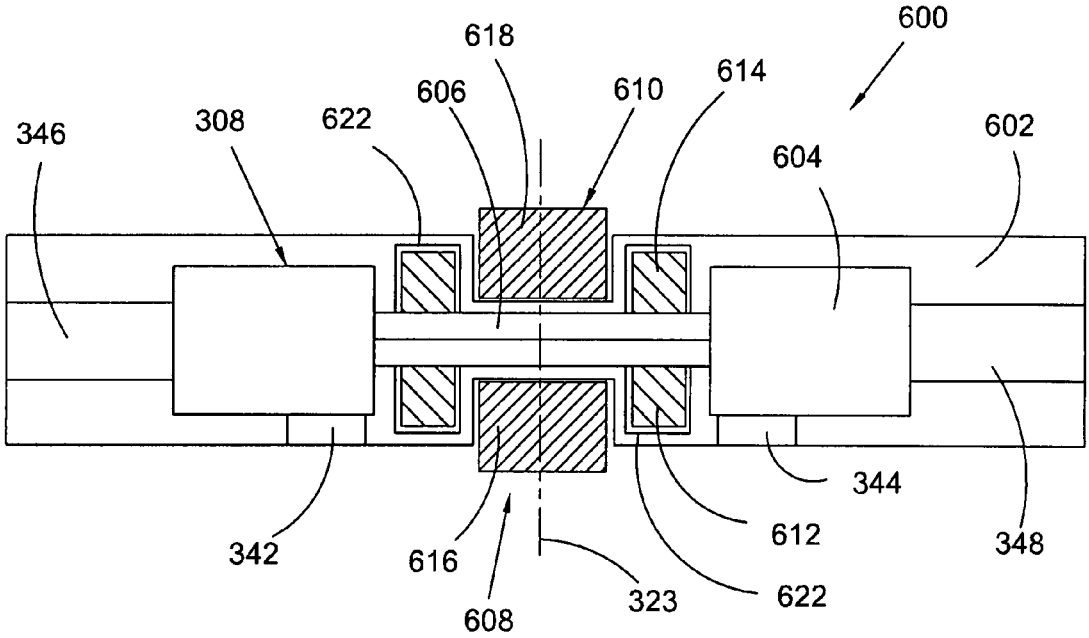
FIG. 27 is a partial cross-sectional view of a present invention engine with direct driving of the rotors.

FIG. 27 is a partial cross-sectional view of present invention engine 600 with direct driving of the rotors. Engine 600 includes chamber 308 formed by chamber structure 602. That is, the cavity in which rotors 604 and 606 in chamber 308 are disposed, is formed by structure 602. Engine 600 includes actuators 608 and 610 arranged to rotationally displace rotors 604 and 606, respectively. In some aspects, actuators 608 and 610 are electric motors and at least a portion of motors 608 and 610 are disposed in, located in, or at least partially enclosed by structure 602. For example, outer motor portions 612 and 614 of motors 608 and 610, respectively, are located in the chamber structure. Inner motor portions 616 and 618 of motors 608 and 610, respectively, are fixed about axis of rotation 323. Outer portions 612 and 614 are fixed to rotors 604 and 606, respectively. In some aspects, the inner portions form all or some of the respective hub for rotors 604 and 606. The chamber structure is configured to enable the outer portions to be rotatable through the structure. For example, slots 620 and 622 form respective paths that enable portions 612 and 614, respectively, to be rotatable.

To displace the rotors, the motors are energized such that respective magnetic fields cause the respective outer sections to rotate about the respective inner sections, rotating the rotors to which the outer sections are connected. It should be understood that the inner and outer motor sections can be configured and arranged in any way known in the art. The shell and remaining portions of engine 600 are not shown. It also should be understood that the actuators can be configured and arranged with respect to the shell and remaining portions of engine 600 in any manner known in the art. In some aspects, the actuators (not shown) for the rotors (not shown) for the other chamber (not shown) in engine 600 are arranged as shown for actuators 608 and 610. In some aspects, the remaining configuration and components for engine 600 are as shown and described for engine 300 and the above discussion regarding engine 300 is applicable to engine 600. For example, the discussion of the operation of actuators 315 and 316 is applicable to actuators 608 and 610.

Figure 28:
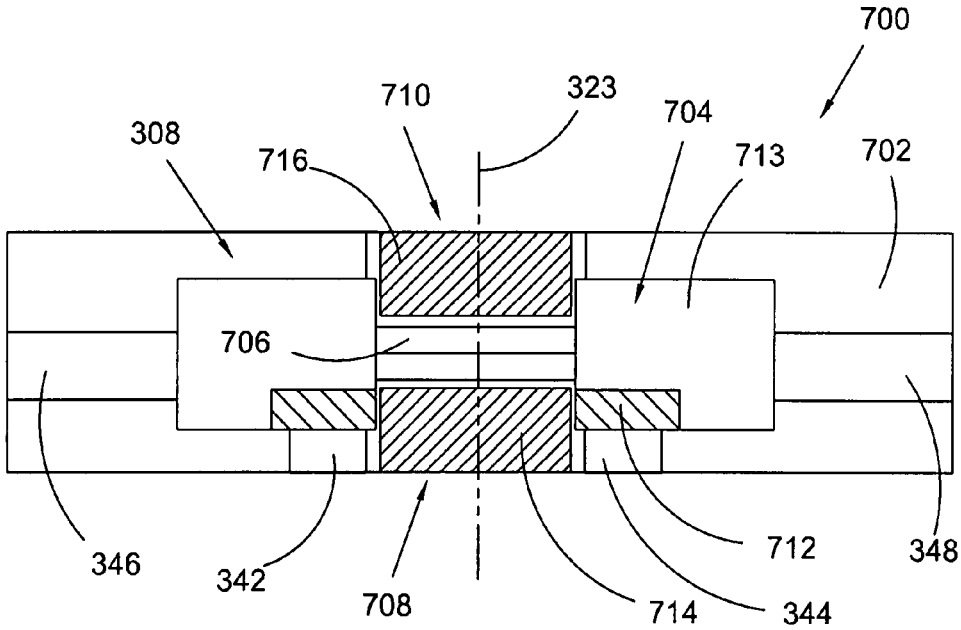
FIG. 28 is a partial cross-sectional view of a present invention engine with direct driving of the rotors.

FIG. 28 is a partial cross-sectional view of present invention engine 700 with direct driving of the rotors. Engine 700 includes chamber 308 formed by chamber structure 702. That is, the cavity in which rotors 704 and 706 in chamber 308 are disposed, is formed by structure 702. Engine 700 includes actuators 708 and 710 arranged to rotationally displace rotors 704 and 706, respectively. In some aspects, actuators 708 and 710 are electric motors and at least a portion of motors 708 and 710 are disposed in, or located in, the respective rotors. For example, outer motor portion 712 of motor 708 is located in paddles portions, or segments, 713 of rotor 704. Inner motor portion 714 of motor 708 is fixed about axis of rotation 323. In some aspects, the inner portions form all or some of the respective hub for rotors 704 and 706. In like manner inner portion 716 of motor 710 is fixed about the axis and an outer portion (not shown) of motor 710 is disposed in rotor 706.

To displace the rotors, the motors are energized such that respective magnetic fields cause the respective outer sections to rotate about the respective inner sections, rotating the rotors in which the outer sections are located. It should be understood that the inner and outer motor sections can be configured and arranged in any way known in the art. The shell and remaining portions of engine 700 are not shown. It also should be understood that the actuators can be configured and arranged with respect to the shell and remaining portions of engine 700 in any manner known in the art. In some aspects, the actuators (not shown) for the rotors (not shown) for the other chamber (not shown) in engine 700 are arranged as shown for actuators 708 and 710. In some aspects, the remaining configuration and components for engine 700 are as shown and described for engine 300 and the above discussion regarding engine 300 is applicable to engine 700. For example, the discussion of the operation of actuators 315 and 316 is applicable to actuators 708 and 710.

Figure 29:
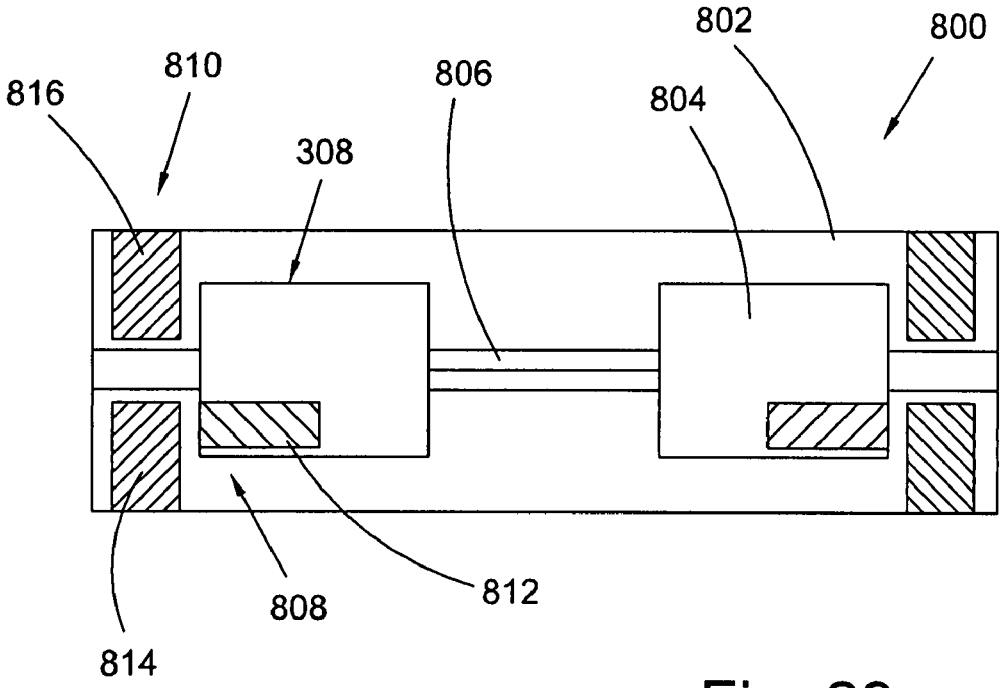
FIG. 29 is a cross-sectional view of a present invention engine with direct driving of the rotors.

FIG. 29 is a partial cross-sectional view of present invention engine 800 with direct driving of the rotors. Engine 800 includes chamber 308 formed by chamber structure 802. That is, the cavity in which rotors 804 and 806 in chamber 308 are disposed, is formed by structure 802. Engine 800 includes actuators 808 and 810 arranged to rotationally displace rotors 804 and 806, respectively. In some aspects, actuators 808 and 810 are electric motors and at least a portion of motors 808 and 810 are disposed in, or located in, the respective rotors. For example, inner motor portion 812 of motor 808 is located in rotor 804. Outer motor portion 814 of motor 808 is fixed about axis of rotation 323. In some aspects, the outer portion is disposed in the chamber structure. In like manner outer portion 816 of motor 810 is fixed about the axis and an inner portion (not shown) of motor 810 is disposed in rotor 806.

To displace the rotors, the motors are energized such that respective magnetic fields cause the respective inner sections to rotate within the respective outer sections, rotating the rotors in which the inner sections are located. It should be understood that the inner and outer motor sections can be configured and arranged in any way known in the art. The shell and remaining portions of engine 800 are not shown. It also should be understood that the actuators can be configured and arranged with respect to the shell and remaining portions of engine 800 in any manner known in the art. In some aspects, the actuators (not shown) for the rotors (not shown) for the other chamber (not shown) in engine 800 are arranged as shown for actuators 808 and 810. In some aspects, the remaining configuration and components for engine 800 are as shown and described for engine 300 and the above discussion regarding engine 300 is applicable to engine 800. For example, the discussion of the operation of actuators 315 and 316 is applicable to actuators 808 and 810.

Figure 30:
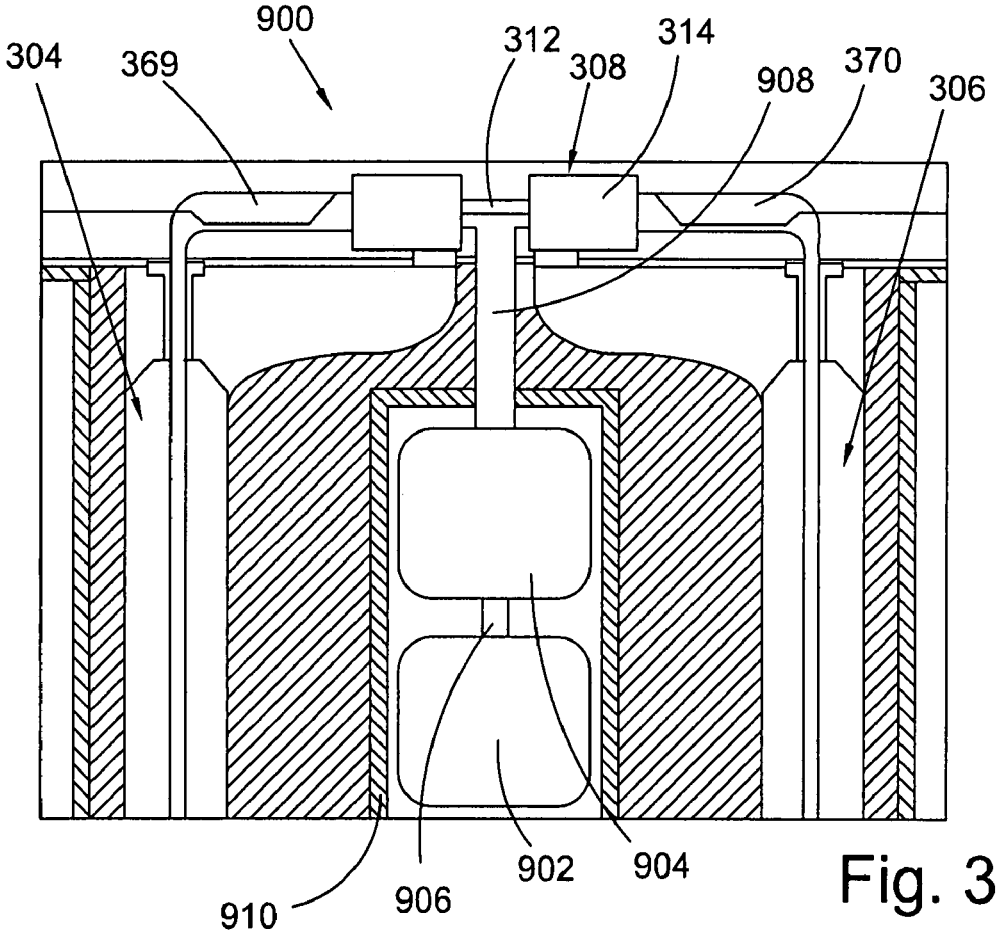
FIG. 30 is a cross-sectional view of a present invention engine with direct driving of the rotors; and, FIG. 31 is a cross-sectional view of a present invention engine with direct driving of the rotors showing cooling for internal motor sections.

FIG. 30 is a partial cross-sectional view of present invention engine 900 with direct driving of the rotors. Actuators 902 and 904 include a single housing each. Shaft 906 is connected to actuator 902 and passes through actuator 904 and is disposed in shaft 906. Shaft 908 is connected to actuator 904. Shaft 908 passes through and is sealed with respect to shell wall 910 by any means known in the art.

Figure 31:
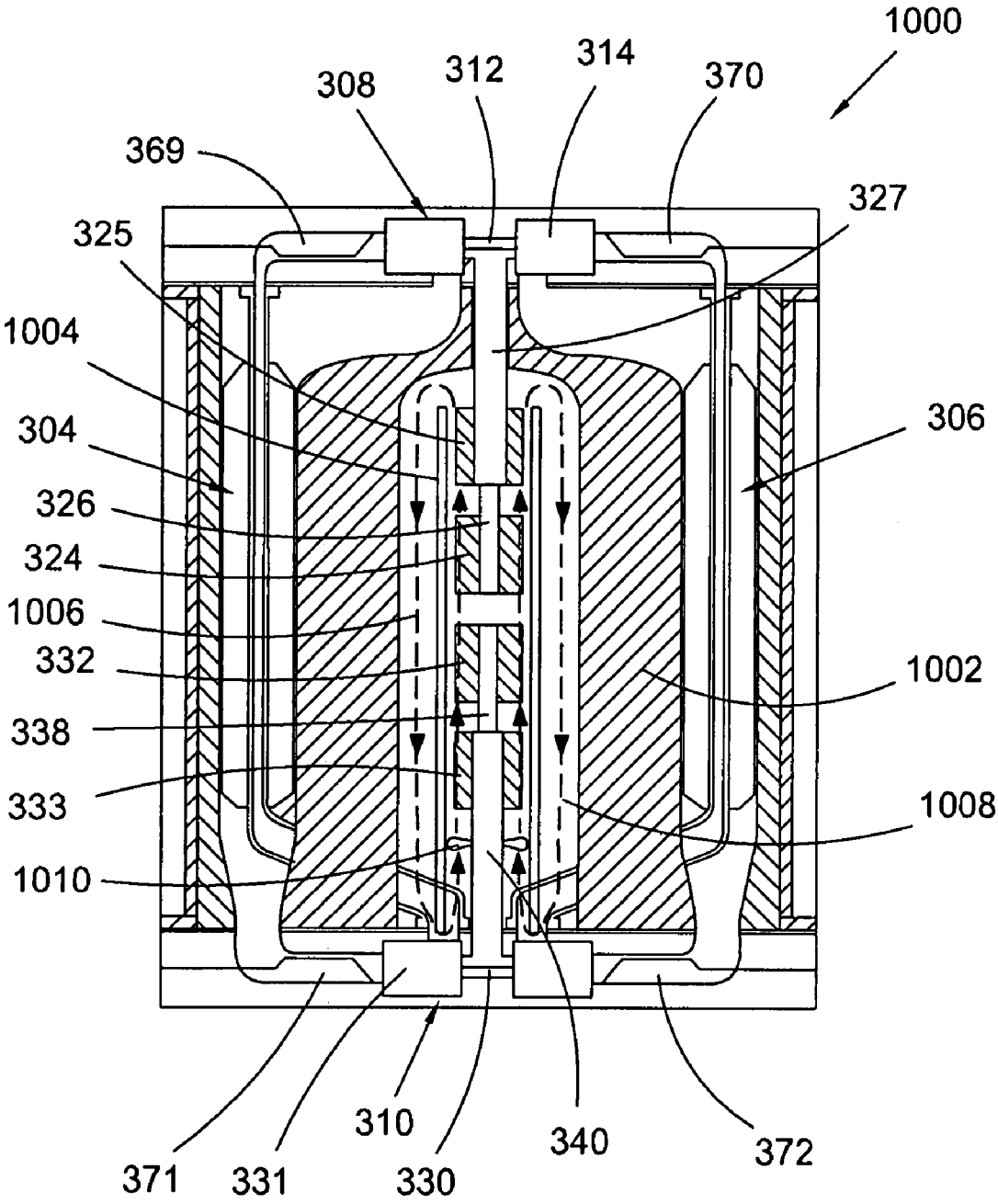

FIG. 31 is a cross-sectional view of present invention engine 1000 with direct driving of the rotors, showing cooling for internal motor sections. Engine 1000 is substantially the same as engine 300 except for fluid cooling of the inner motor sections. Insulation 1002 and internal fluid guides 1004 along with chamber 310 form an enclosed area through which fluid is circulated to cool the inner motor sections. Paths 1006 and 1008 show the fluid flow. It should be understood that the fluid may pass through channels or other paths through the backside of the cooler chamber (not shown), cooling the circulating fluid and hence, the inner motor sections. Any cooling fluid known in the art can be used. In some aspects, the working fluid is used to cool the motors. For example, a portion of the working fluid is circulated through the paths shown and through the back side of the cooler chamber wall. In some aspects, paddles, such as paddles 1010 are attached to rotor shafts to augment or direct the cooling fluid flow.

The following should be viewed in light of FIGS. 14-31. It should be understood that a present invention engine is not limited to the thermodynamic cycles described above and that a present invention engine can be used with any thermodynamic cycle known in the art. Further, it should be understood that rotors in a present invention engine are not limited to the shapes shown in the drawings and that any shape known in the art, for example, oval, can be used for the rotors. It also should be understood that a present invention engine is not limited to the planar configuration shown in the figures. For example, one side of a motor, chamber face, and associated heat exchanger can be placed on the surface that needs to be cooled, for example, surface 367 in FIG. 14, while the other motor, chamber face, and associated heat exchanger can be placed along the surface to which the heat is to be expelled, for example, surface 368 in FIG. 14. This is possible since there is no mechanical connection between the two ends/surfaces, only fluid communication via the regenerator. Further, with respect to a longitudinal axis for a present invention engine, for example, axis 380 in FIG. 14: chamber faces can be radially disposed outside of the regenerators and parallel to the axis; one face can be radially disposed outside of the regenerators and parallel to the axis and the other can be radially disposed outside of the regenerators and orthogonal; or the chamber faces can be radially disposed outside of the regenerators and orthogonal to the axis. It should be understood that any circumferential, radial, or longitudinal configuration is possible within the above combinations.

The following should be viewed in light of FIGS. 14-31. In some aspects, one or more of the actuators is configured as a combination actuator and generator. For example, rather than applying energy to the actuator to displace rotors, the working fluid operates to displace the respective rotors and hence the shaft for the actuator. The rotation of the shaft then causes the generation of energy by the actuator/generator. In some aspects a separate motor and a separate generator are connected to a rotor shaft. For example, in FIG. 16 a separate generator (not shown) could be connected to shaft 326 so that motor 315 would supply power to the shaft and the generator would receive power from the shaft. In some aspects (not shown), a present invention actuator/generator includes a planetary gear set. The gear set increases the rotational rate transmitted from the rotors to the actuator/generator. For example, for some production systems, it is necessary for the actuator/generator to operate at a higher rate than the rotors. Thus, the gear set operates as a reduction gear system. The preceding arrangement can produce a more precise torque curve for the actuator/generator.

Returning to FIG. 14, other aspects of a present invention engine can be seen. In some aspects, the chambers are formed of top and bottom halves, for example, top halves 460 and 462 of chambers 308 and 310, respectively, and bottom halves 464 and 466 of chambers 308 and 310, respectively. Insulation segments 468 insulate the regenerators and partially form chamber 470 housing the actuators. Insulation segments 472 and 474 insulate the regenerators and the engine in general. It should be understood that a present invention engine is not limited to any particular type or configuration of insulation or insulating components and that any type of configuration of insulation or insulating components known in the art are included in the spirit and scope of the claimed invention.

Returning to FIGS. 14 through 25, another novel and advantageous aspect of a present invention engine can be illustrated. The high pressure exchange shown in FIGS. 24 and 25 and the sequencing of high and low pressure port in the chambers enables a present invention engine to function with isolated compression and expansion of the fluid, which is a key to efficiency. In prior art Stirling engine designs, the working fluid being compressed and expanded is in fluid communication with the working fluid in the regenerator. For example, for a given piston movement, the amount of compression of the working fluid in the cylinder is diminished, since the compressive force is applied to a larger volume of fluid (fluid in the cylinder plus the fluid in the regenerator). Excluding the mechanics of the engine, efficiency of a thermodynamic cycle is the area inside of the Pressure-Volume curve as noted above. The width of the curve is proportional to the compression of the working fluid. Therefore, increasing compression of the fluid increases the area of the curve, and hence, the efficiency of the cycle. A present invention engine isolates the gas to be compressed in a compression chamber, for example, chamber 308, by using the rotors to close off the high and low pressure ports during the compression cycle, which results in greater compression of the gas in the chamber and greater efficiency as compared to the prior art engines.

It should be understood that any actuator known in the art, including, but not limited to electric, hydraulic, and pneumatic, can be used for the actuators shown in FIGS. 14-30. For those aspects in which the actuators are electric motors, any electric motor known in the art can be used. In FIG. 16, outer housings 476, 478, 480, and 482, for motors 316, 315, 317, and 318 are shown. It should be understood that any outer housing known in the art can be used and that any material or configuration known in the art can be used for the outer housings.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. A thermodynamic cycle heat engine comprising:

a regenerator;

first and second chambers in fluid communication with said regenerator;

first and second rotors disposed within said first chamber, said first and second rotors forming at least a pair of spaces within said first chamber;

third and fourth rotors disposed within the second chamber;

at least one actuator; and, wherein said regenerator and said first and second chambers form at least a portion of a closed space for a working fluid, wherein said at least one actuator is arranged to displace said first and second rotors about an axis of rotation for said first and second rotors and to displace the third and fourth rotors about an axis of rotation for the third and fourth rotors, wherein at least a portion of said at least one actuator is fixedly secured to said first and second rotors, wherein the first rotor is displaceable with respect to the second rotor and the third rotor is displaceable with respect to the fourth rotor, and wherein no more than two rotors are disposed in the first chamber and no more than two rotors are disposed in the second chamber.

2. The thermodynamic cycle heat engine of claim 1 wherein said first and second rotors comprise first and second shafts, respectively, and wherein said first and second shafts are fixedly secured to said at least one actuator.

3. The thermodynamic cycle heat engine of claim 2 wherein said first shaft is at least partially disposed within said second shaft.

4. The thermodynamic cycle heat engine of claim 1 further comprising a housing and wherein at least a portion of said at least one actuator is disposed outside said housing.

5. The thermodynamic cycle heat engine of claim 1 further comprising a housing and wherein said at least one actuator comprises first and second actuators and said first actuator is disposed outside said housing.

6. The thermodynamic cycle heat engine of claim 1 wherein said chamber is formed within a chamber structure and at least a portion of said at least one actuator is disposed within said chamber structure.

7. The thermodynamic cycle heat engine of claim 1 wherein said first and second rotors comprise first and second hubs, respectively, collinear with said axis of rotation and respective paddle sections radiating radially outward, with respect to said axis of rotation, from said first and second hubs, and wherein at least a portion of said at least one actuator is at least partially disposed in said respective paddle sections.

8. The thermodynamic cycle heat engine of claim 1 wherein said first and second rotors comprise first and second hubs, respectively, collinear with said axis of rotation, and wherein at least a first portion of said at least one actuator forms said first and second hubs.

9. The thermodynamic cycle heat engine of claim 8 wherein said first and second hubs comprise all of said at least one actuator.

10. The thermodynamic cycle heat engine of claim 1 wherein said first and second rotors comprise first and second hubs, respectively, collinear with said axis of rotation, wherein said at least one actuator comprises at least one first portion and at least one second portion, wherein said at least one first portion forms said first and second hubs, and wherein said at least one second portion is disposed outside said chamber.

11. The thermodynamic cycle heat engine of claim 1 wherein said at least a portion of said at least one actuator further comprises at least one rotating component; and said engine further comprising a torque path between said at least one rotating component and said first and second rotors, wherein said torque path is fixed with respect to said at least one rotating component and said first and second rotors.

12. The thermodynamic cycle heat engine of claim 1 wherein said at least one actuator further comprises at least one electric motor.

13. The thermodynamic cycle heat engine of claim 1 wherein said at least one actuator further comprises at least one hydraulic actuator.

14. The thermodynamic cycle heat engine of claim 1 wherein said at least one actuator is arranged to receive energy from said first and second rotors and to operate as a generator.

15. The thermodynamic cycle heat engine of claim 1 further comprising:

a sensor arranged to detect a condition associated with operation of said chamber; and, a controller arranged to receive a signal from said sensor regarding said condition and to control operation of said at least one actuator responsive to said signal.

16. The thermodynamic cycle heat engine of claim 1 further comprising a heat exchanger in fluid communication between said regenerator and said chamber.

17. A thermodynamic cycle heat engine comprising:

a regenerator;

a first chamber in fluid communication with said regenerator;

a second chamber in fluid communication with said regenerator;

first and second rotors disposed within said first chamber, said first and second rotors forming at least a pair of spaces within said first chamber;

third and fourth rotors disposed within said second chamber;

a first sensor arranged to detect a first condition associated with operation of said first chamber;

at least one actuator arranged to displace said first, second, third, and fourth rotors about respective axis of rotation for said first and second rotors and for the third and fourth rotors responsive to said detected first condition; and, a controller arranged to receive a signal from said first sensor regarding said first condition and to control operation of said at least one actuator responsive to said signal, wherein said regenerator and said first and second chambers form a closed space for a working fluid, and wherein said controller is arranged to control phasing of said first and second rotors with respect to said third and fourth rotors.

18. The thermodynamic cycle heat engine of claim 17 wherein said first and second rotors are independently displaceable about said axis of rotation and said controller is arranged to control relative rotation of said first and second rotors with respect to each other.

19. The thermodynamic cycle heat engine of claim 17 wherein said controller is arranged to control a speed of a relative rotation between said first and second rotors.

20. The thermodynamic cycle heat engine of claim 17 wherein said controller is arranged to control circumferential spacing, with respect to said axis, between said first and second rotors.

21. The thermodynamic cycle heat engine of claim 17 wherein said at least one actuator is arranged to receive energy from said first and second rotors and to operate as a generator.

22. The thermodynamic cycle heat engine of claim 17 further comprising a heat exchanger in fluid communication with said regenerator and one of said first and second chambers.

23. The thermodynamic cycle heat engine of claim 17 wherein at least a portion of said at least one actuator is fixedly secured to said first and second rotors.

24. A thermodynamic cycle heat engine comprising:

a regenerator;

a chamber in fluid communication with said regenerator;

a heat exchanger in fluid communication between said regenerator and said chamber;

first and second rotors disposed within said chamber; third and fourth rotors disposed within a second chamber and, at least one actuator, wherein:

said regenerator and said chamber form at least a portion of a closed space for a working fluid; and, said at least one actuator is arranged to:

displace said first and second rotors about an axis of rotation for said first and second rotors; and, control displacement of the first rotor independent of rotation of the second rotor.

25. The thermodynamic cycle heat engine of claim 24 wherein at least a portion of said at least one first actuator is fixedly secured to said first and second rotors.

26. The thermodynamic cycle heat engine of claim 24 further comprising:

a sensor arranged to detect a condition associated with operation of said chamber; and, a controller arranged to receive a signal from said sensor regarding said condition and to control operation of said at least one actuator responsive to said signal.

27. The thermodynamic cycle heat engine of claim 24 wherein said at least one actuator is arranged to receive energy from said first and second rotors and to operate as a generator.

28. A thermodynamic cycle heat engine comprising:

a regenerator;

a compression chamber in fluid communication with said regenerator;

first and second rotors disposed within said compression chamber, said first and second rotors forming at least a first pair of spaces within said compression chamber;

an expansion chamber in fluid communication with said regenerator;

third and fourth rotors disposed within said expansion chamber, said third and fourth rotors forming at least a second pair of spaces within said expansion chamber;

at least one first and second rotary actuators;

a sensor arranged to detect a condition associated with one of said first and second chambers; and, a controller arranged to receive a signal from said sensor regarding said condition and to control operation of one of said at least one first and second actuators responsive to said signal, wherein said regenerator and said compression and expansion chambers form a closed space for a working fluid, wherein said at least one first rotary actuator is arranged to displace said first and second rotors about an axis of rotation for said first and second rotors and said at least one second rotary actuator is arranged to displace said third and fourth rotors about an axis of rotation for said third and fourth rotors, and wherein at least a portion of said at least one first actuator is fixedly secured to said first and second rotors and at least a portion of said at least one second actuator is fixedly secured to said third and fourth rotors.

29. A method for operating a thermodynamic cycle heat engine comprising:

fixedly securing at least a portion of at least one actuator to first and second rotors disposed within a first chamber and to third and fourth rotors disposed within a second chamber;

rotating said first and second rotors and said third and fourth rotors;

rotating the first rotor with respect to the second rotor;

rotating the third rotor with respect to the fourth rotor;

forming at least one pair of spaces having cyclically varying volumes within said first chamber;

passing working fluid from said first chamber through first and second bi-directional regenerators; and, passing said working fluid from said first and second bi-directional regenerators to said first chamber, wherein no more than two rotors are disposed in the first chamber and no more than two rotors are disposed in the second chamber.

30. The method of claim 29 wherein said first and second rotors comprise first and second shafts, respectively, and wherein fixedly securing at least a portion of at least one actuator comprises fixedly securing said first and second shafts to said at least one actuator.

31. The method of claim 30 further comprising at least partially disposing said first shaft within said second shaft.

32. The method of claim 29 wherein said chamber is formed within a chamber structure and said method further comprising disposing at least a portion of said at least one actuator within said chamber structure.

33. The method of claim 29 wherein said first and second rotors comprise first and second hubs, respectively, collinear with an axis of rotation for the for the at least one actuator, and respective paddle sections radiating radially outward, with respect to said axis of rotation, from said first and second hubs and said method further comprising at least partially disposing at least a portion of said at least one actuator is in said respective paddle sections.

34. The method of claim 29 wherein said first and second rotors comprise first and second hubs, respectively, collinear with an axis of rotation for said at least one actuator, and said method further comprising forming said first and second hubs with at least a portion of said at least one actuator.

35. The method of claim 29 further comprising:

said working fluid applying force in said chamber to rotate said first and second rotors; and, generating energy through said at least one actuator in response to said rotation of said first and second rotors.

36. The method of claim 29 further comprising:

detecting a condition associated with operation of said chamber; and, controlling said at least one actuator to displace said first and second rotors about an axis of rotation for said first and second rotors responsive to said detected condition.

37. A method for operating a thermodynamic cycle heat engine comprising:

rotating first and second rotors within a first chamber;

rotating third and fourth rotors within a second chamber in fluid communication with first and second regenerators;

forming at least one pair of spaces having cyclically varying volumes within said first chamber;

passing working fluid from said first chamber through the first and second bi-directional regenerators;

passing said working fluid from said first and second bi-directional regenerators to said first chamber;

detecting a condition associated with operation of said first chamber; and, controlling at least one actuator to:

displace said first and second rotors about an axis of rotation for said first and second rotors responsive to said detected conditions;

displace the third and fourth rotors about an axis of rotation for the third and fourth rotors responsive to the detected condition; and, control phasing of the first and second rotors with respect to the third and fourth rotors.

38. The method of claim 37 wherein said first and second rotors are independently displaceable about said axis of rotation, and wherein controlling said at least one actuator further comprising at least one of controlling relative rotation of said first and second rotors with respect to each other, controlling a speed of said relative rotation between said first and second rotors, and controlling circumferential spacing, with respect to said axis of rotation, between said first and second rotors.

39. The method of claim 37 further comprising fixedly securing at least a portion of at least one actuator to said first and second rotors.

40. A method for operating a thermodynamic cycle heat engine comprising:

rotating first and second rotors in a chamber;

rotating third and fourth rotors in a second chamber;

controlling rotation of the first rotor independent of rotation of the second rotor;

forming at least one pair of spaces having cyclically varying volumes within said chamber;

passing working fluid from said chamber through first and second bi-directional regenerators;

passing said working fluid from said first and second bi-directional regenerators to said chamber; and, disposing at least one heat exchanger in fluid communication between said first and second regenerators and said chamber.

41. The method of claim 40 further comprising fixedly securing at least a portion of at least one actuator to said first and second rotors.

42. The method of claim 40 further comprising:

detecting a condition associated with operation of said chamber; and, controlling at least one actuator to displace said first and second rotors about an axis of rotation for said first and second rotors responsive to said detected condition.

* * * * *